US008029082B2

(12) United States Patent
Azami et al.

(10) Patent No.: US 8,029,082 B2
(45) Date of Patent: Oct. 4, 2011

(54) LIQUID DISCHARGING APPARATUS, LIQUID DISCHARGING METHOD, AND PROGRAM

(75) Inventors: Nobuaki Azami, Matsumoto (JP); Hirokazu Nunokawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 356 days.

(21) Appl. No.: 12/147,351

(22) Filed: Jun. 26, 2008

(65) Prior Publication Data

US 2009/0002408 A1 Jan. 1, 2009

(30) Foreign Application Priority Data

Jun. 27, 2007 (JP) ..... 2007-169659

(51) Int. Cl.
*B41J 29/38* (2006.01)
*B41J 2/175* (2006.01)

(52) U.S. Cl. ..... 347/6; 347/17; 347/93

(58) Field of Classification Search ..... None
See application file for complete search history.

(56) References Cited

U.S. PATENT DOCUMENTS 6,454,379 B1 * 9/2002 Taneya et al. ..... 347/19
2006/0209142 A1 * 9/2006 Kachi ..... 347/85

FOREIGN PATENT DOCUMENTS

JP 2003-182056 7/2003
JP 2006-256262 9/2006
JP 2006-281454 10/2006
JP 2006-321188 11/2006

* cited by examiner

*Primary Examiner* — Omar Rojas
(74) *Attorney, Agent, or Firm* — Workman Nydegger

(57) ABSTRACT

A liquid discharging apparatus includes a head that is driven in response to a driving signal to discharge liquid, a controller that drives the head by generating the driving signal, an adjustment unit that adjusts the temperature of the liquid, and a supply path that supplies the head with the liquid having the temperature adjusted by the adjustment unit. The controller alters the driving signal in accordance with a flow amount of the liquid, which flows in the supply path.

8 Claims, 15 Drawing Sheets

LIQUID DISCHARGING APPARATUS, LIQUID DISCHARGING METHOD, AND PROGRAM

BACKGROUND

1. Technical Field

The present invention relates to a liquid discharging apparatus, a liquid discharging method, and a program used therewith.

2. Related Art

Ink jet printers are known examples of liquid discharging apparatuses that discharge liquid. In a printer of this type, a head is supplied with ink, and the head is driven to discharge the ink.

A technology in which, when the ink is supplied to the head, the ink is heated by using a heater to heat a supply path for supplying the ink to the head has been proposed (see, for example, JP-A-2006-281454).

In a case in which the heater is installed at a position at a distance from the head, the ink heated by the heater naturally cools by the time it arrives at the head, and its temperature decreases. A manner in which the temperature of the ink decreases differs according to a natural cooling time. Thus, the temperature of the ink in the head differs according to a travel time (natural cooling time) from after the ink is heated by the heater until the ink arrives at the head. For example, in a case in which a flow amount of the ink in the supply path is large, the travel time is short. Thus, the ink in the head is warm. Alternatively, in a case in which the flow amount of the ink in the supply path is small, the travel time is long. Thus, the ink in the head is cool.

Such a change in temperature of the ink changes the viscosity of the ink. In addition, in a case where the head is similarly driven despite the change in viscosity of the ink, the amount of each ink droplet discharged from the head changes according to the viscosity of the ink. A problem of the change in the amount of the ink droplets discharged from the head is not limited to printers that discharge ink, and similarly occurs also in liquid discharging apparatuses that discharge liquid.

SUMMARY

An advantage of some aspects of the invention is to maintain the amount of liquid droplets discharged.

According to an aspect of the invention, there is provided a liquid discharging apparatus including a head that is driven in response to a driving signal to discharge liquid, a controller that drives the head by generating the driving signal, an adjustment unit that adjusts the temperature of the liquid, and a supply path that supplies the head with the liquid having the temperature adjusted by the adjustment unit, wherein the controller alters the driving signal in accordance with a flow amount of the liquid, which flows in the supply path.

Other features of the invention will be apparent from the description of this specification and the accompanying drawings.

The description of this specification and the accompanying drawings clarifies at least the following.

That is, a liquid discharging apparatus is clarified that includes a head that is driven in response to a driving signal to discharge liquid, a controller that drives the head by generating the driving signal, an adjustment unit that adjusts the temperature of the liquid, and a supply path that supplies the head with the liquid having the temperature adjusted by the adjustment unit, wherein the controller alters the driving signal in accordance with a flow amount of the liquid, which flows in the supply path.

According to the liquid discharging apparatus, by altering a driving signal, a head can alter the amount of discharged liquid. In a case where the liquid discharged by the head is in the form of droplets, and the droplets have a target quantity, the amount of discharged liquid can be maintained at the target quantity.

It is preferable that the flow amount be calculated on the basis of discharge data for causing the head to discharge the liquid, and it is preferable that the controller alter the driving signal in accordance with the calculated flow amount. This makes it possible to alter the driving signal without touching the liquid.

It is preferable that, on the basis of flow amount calculated on the basis of the discharge data, the controller calculate a travel time representing a time taken until the liquid having the temperature adjusted by the adjustment unit arrives from the position of the adjustment unit at the head, and alter the driving signal in accordance with the calculated travel time. This makes it possible to calculate the travel time without touching the liquid. The calculated travel time corresponds to a period in which the liquid, which flows in the supply path, naturally cools.

It is preferable that the controller estimate the temperature of the liquid in the head on the basis of the calculated travel time, and alter the driving signal in accordance with the estimated temperature. This makes it possible to estimate the temperature of the liquid for altering the driving signal without touching the liquid.

It is preferable that the controller alter the waveform of the driving signal on the basis of the discharge data. This makes it possible to alter the amount of liquid droplets discharged from the head.

It is preferable that the liquid discharging apparatus further include a flowmeter that measures the flow amount of the liquid, which flows in the supply path, and the controller alter the driving signal in accordance with the measured flow amount. With the flowmeter, data of the flow amount for altering the driving signal is easily acquired. Accordingly, a processing load on the controller is small.

It is preferable that the liquid discharging apparatus further include a head that is different from the head and that discharges the liquid supplied through the supply path. In this case, also the amount of liquid droplets discharged from the different head can be altered similarly to the case of the above head.

It is preferable that the liquid discharging apparatus further include a head that is different from the head and that discharges liquid supplied through a supply path different from the supply path. In this case, the amount of liquid droplets discharged from the different head can be altered similarly to the case of above head.

According to another aspect of the invention, there is provided a liquid discharging method including adjusting the temperature of liquid, supplying a head with the liquid having the adjusted temperature, generating a driving signal, and driving the head in response to the driving signal and discharging the liquid from the head, wherein the driving signal is altered in accordance with a flow amount of the liquid supplied to the head.

In addition, according to another aspect of the invention, there is provided a program for a liquid discharging apparatus including a head that is driven in response to a driving signal to discharge liquid, a controller that drives the head by generating the driving signal, an adjustment unit that adjusts the temperature of the liquid, and a supply path that supplies the head with the liquid having the temperature adjusted by the adjustment unit, the program causing the liquid discharging apparatus to alter the driving signal in accordance with a flow amount of the liquid, which flows in the supply path.

Further, also a storage medium which stores the above program and which is readable by the above liquid discharging apparatus is provided.

BRIEF DESCRIPTION OF THE DRAWINGS

The invention will be described with reference to the accompanying drawings, wherein like numbers reference like elements.

FIGS. 5A to 5D are timing charts showing a relationship between the waveform of a switch operation signal and the waveform of a driving signal that is input to a piezoelectric element, in which FIG. 5A shows a case where the gradation value of a pixel is "0", in which FIG. 5B shows a case where the gradation value of a pixel is "1", in which FIG. 5C shows a case where the gradation value of a pixel is "2", and in which FIG. 5D shows a case where the gradation value of a pixel is "3".

FIG. 11 is a graph illustrating a travel time calculated in travel time calculation in step S102 shown in FIG. 10, in which FIG. 11A shows flow amount data obtained when a flow amount is less, and in which

FIGS. 13A and 13B are schematic graphs showing part of a history (flow amount data) of an ink flow amount, in which FIG. 13A shows a flow amount in a case where the history of the ink flow amount includes a period in which the flow amount is "0", in which FIG. 13B shows a flow amount in a case where there is no history of the flow amount of ink, and in which

FIGS. 15A and 15B are graphs illustrating a travel time in travel time calculation, in which FIG. 15A illustrates a travel time Δt1 in which black ink arrives from a head case contact at a head contact, and, in which FIG. 15B illustrates a travel time Δt2 in which black ink arrives from a heater passage position at a head case contact.

DESCRIPTION OF EXEMPLARY EMBODIMENTS

Figure 1:
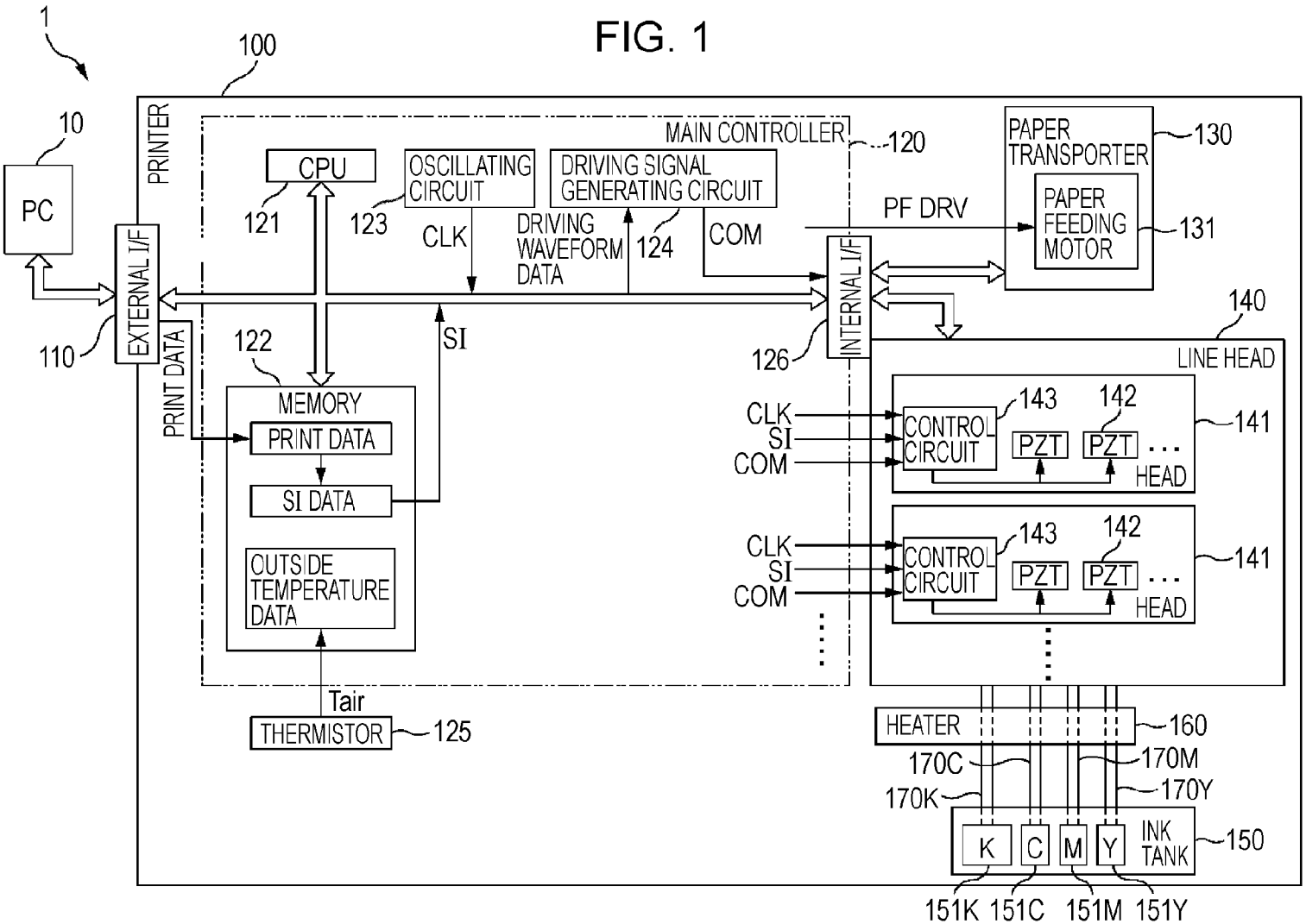
FIG. 1 is a schematic block diagram showing the configuration of a printing system (including a printer) according to a first embodiment of the present invention.

FIG. 1 is a schematic block diagram showing the configuration of a printing system (including a printer) according to a first embodiment of the invention. In FIG. 1, thick arrows indicate connections, and thin arrows indicate flows of data such as signals.

The printing system 1 shown in FIG. 1 includes a personal computer (PC) 10 and a printer 100 connected to the PC 10. The PC 10 can transmit print data to the printer 100. The printer 100 is an ink discharging apparatus that discharges ink in order to print an image corresponding to the print data.

As shown in FIG. 1, the printer 100 includes an external interface (I/F) 110, a main controller 120, a paper transporter 130, a printing head group (hereinafter referred to as a "line head") 140, an ink tank 150, a temperature adjustment heater (hereinafter referred to simply as a "heater") 160, and ink supply tubes (hereinafter referred to as simply "tubes") 170K, 170C, 170M, and 170Y.

The PC 10 is connected to the external interface 110, whereby data communication can be performed between the PC 10 and the printer 100.

The main controller 120 is used to control the printer 100 and includes a central processing unit (CPU) 121 and a memory 122. The CPU 121 controls the paper transporter 130, the line heads 140, and the heater 160, and processes print data received from the PC 10. In the memory 122, print data received from the PC 10, dot gradation data (SI data) generated by the CPU 121 from the print data are written. The dot gradation data is data that represents a gradation level of each pixel by using one of four gradation values "0" to "3".

The paper transporter 130 transports printing paper necessary for printing by the printer 100. A paper feeding motor (PF) motor 131 included in the paper transporter 130 is used to transport the printing paper.

The ink tank 150 contains ink packs 151K, 151C, 151M, and 151Y. The ink packs 151K, 151C, 151M, and 151Y contain black ink, cyan ink, magenta ink, and yellow ink, respectively.

The line head 140 includes a group of heads 141 that downwardly discharge ink in a vertical direction. The heads 141 are arranged in a line head manner (see FIG. 3). Each head 141 includes a plurality of piezoelectric elements (PZT) 142 and a control circuit 143 connected to the piezoelectric elements 142. The control circuit 143 performs control for driving each piezoelectric element 142.

The tubes 170K, 170C, 170M, and 170Y connect the ink tank 150 and the line heads 140. The black ink is supplied from the ink pack 151K to the tube 170K. The black ink that flows into the tube 170K is supplied to the heads 141 included in the line head 140. Similarly to the black ink, the cyan ink, the magenta ink, and the yellow ink are supplied from the ink packs 151C, 151M, and 151Y to the heads 141.

The heater 160 is used to adjust ink to have a predetermined temperature, and has a heating function and a heat reserving function that are activated when a main power supply (not shown) of the printer 100 is in an on-state. The heater 160 is disposed so as to surround a part of regions for the four tubes 170K, 170C, 170M, and 170Y. Thus, the heater 160 has a heating function of heating the inks that flow in the tubes 170K, 170C, 170M, and 170Y. The heating function causes the inks to be heated to a heat reserving temperature $T_o$ that is set for the heat reserving function.

The main controller 120 further includes an oscillating circuit 123, a driving signal generating circuit 124, a thermistor 125, an internal interface (I/F) 126. In the first embodiment, the number of driving signal generating circuits 124 agrees with the number of (four) head groups 140K, 140C, 140M, and 140Y, which are described below with reference to FIG. 3.

The oscillating circuit 123 generates a clock signal CLK. The driving signal generating circuit 124 generates a driving signal COM (FIG. 4) by using driving waveform data. The driving waveform data is created by the CPU 121, and represents potential-change points that are necessary for specifying the waveform of the driving signal COM. The potential change points will be described below with reference to FIG. 4. The driving signal COM generated by the driving signal generating circuit 124 is used by each control circuit 143 in each corresponding head 141 in the case of performing printing.

The thermistor 125 is connected to the main controller 120 via the internal interface (I/F) 126. The thermistor 125 measures an internal temperature (outside air temperature $T_{air}$) of the printer 100, and inputs data of the measured outside air temperature $T_{air}$ to the main controller 120. In the main controller 120, the CPU 121 writes the outside air temperature $T_{air}$ input from the thermistor 125 in the memory 122, whereby the outside air temperature $T_{air}$ is stored.

The paper transporter 130, the line head 140, the heater 160, etc., are connected to the internal interface 126. For example, the CPU 121 of the main controller 120 transmits signals to the paper feeding motor 131 of the paper transporter 130 and the control circuit 143 of each head 141, and receives data of the outside air temperature $T_{air}$ from the thermistor 125 via the internal interface 126.

Transportation of Printing Paper

Figure 2:
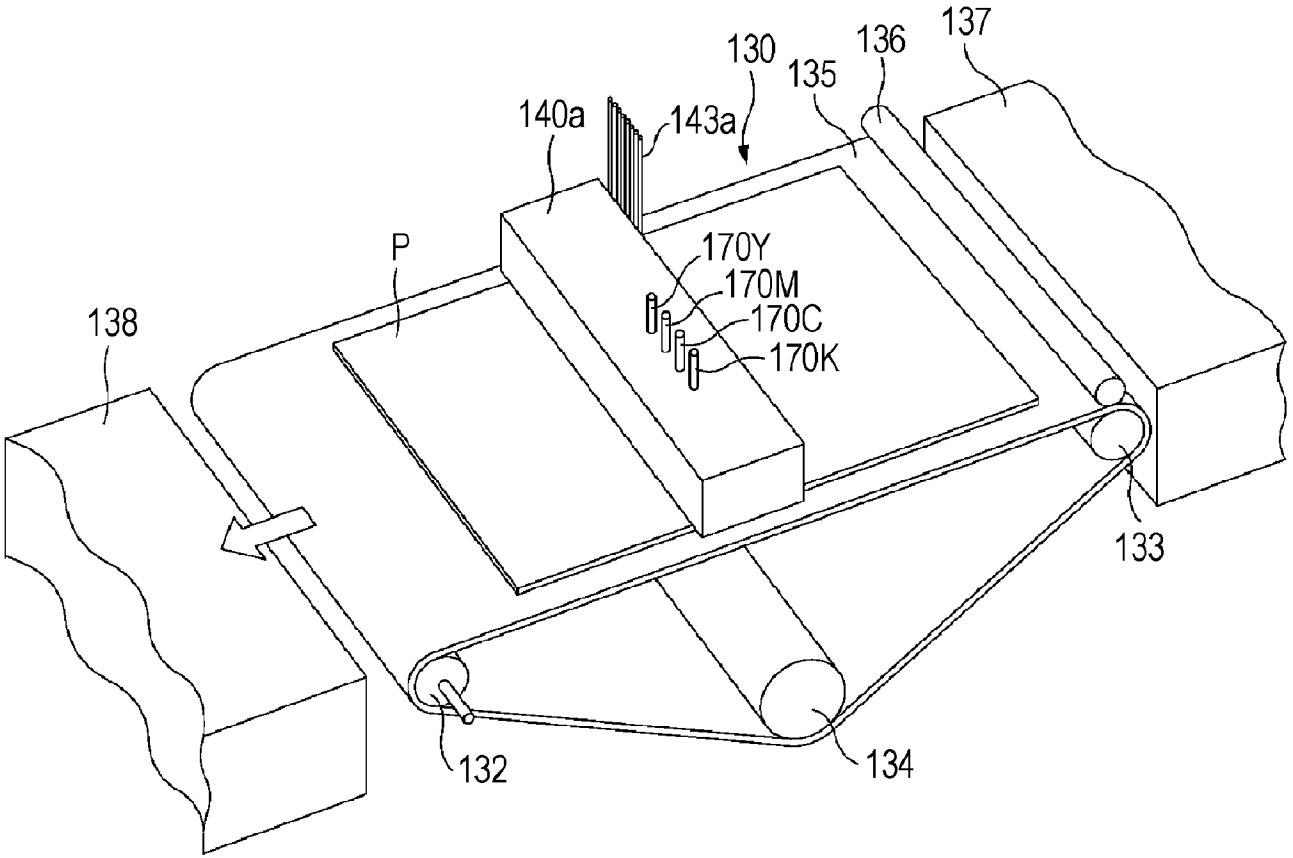
FIG. 2 is a schematic perspective view showing the exterior of the paper transporter shown in FIG. 1.

FIG. 2 is a schematic perspective view showing the exterior of the paper transporter 130 shown in FIG. 1. FIG. 2 also shows the state of printing paper P being transported by the paper transporter 130.

The paper transporter 130 includes a belt conveyor in order to transport the printing paper P. As shown in FIG. 2, the belt conveyor includes a driving roller 132, driven rollers 133 and 134, and a loop belt 135.

The loop belt 135 is extended on a curved face formed by the driving roller 132 and the driven rollers 133 and 134. The driven roller 134 gives tension to the loop belt 135. When the printing paper P is transported, the shaft of the driving roller 132 is driven to rotate at constant speed by the paper feeding motor 131. This driving for rotation also revolves the loop belt 135 at constant speed. In addition, in accordance with the revolution of the loop belt 135, the driven rollers 133 and 134 also rotate. These cooperatively operate, whereby the loop belt 135 smoothly revolves, with it supported by three points, that is, the driving roller 132, and the driven rollers 133 and 134.

In addition, the paper transporter 130 includes a paper feeder (not shown). The paper feeder feeds a sheet of the printing paper P in a paper feeding tray (not shown) toward the belt conveyor along the paper feeding face 137 shown in FIG. 2.

In addition, the paper transporter 130 includes a pressing roller 136 disposed above the belt conveyor. The pressing roller 136 faces the driven roller 133, with the loop belt 135 provided therebetween, and the sheet of the printing paper P fed from the paper feeder is pinched by the pressing roller 136 and the driven roller 133.

In FIG. 2, after the sheet of the printing paper P is fed by the paper feeder, the fed sheet proceeds in the arrow direction (hereinafter referred to as the "paper transporting direction") shown in FIG. 2. At this time, first, the sheet of the printing paper P passes between the pressing roller 136 and the driven roller 133. Second, the sheet of the printing paper P is transported by the belt conveyor. After that, the transported sheet is expelled along the paper expelling face 138 shown in FIG. 2.

Head Case

In addition, FIG. 2 also shows a head case 140*a*. The head case 140*a* is a housing for covering all the heads 141 included in the line head 140. The head case 140*a* has thereon holes through which the tubes 170K, 170C, 170M, and 170Y pass.

As shown in FIG. 2, the head case 140*a* is a rectangular parallelepiped. A longitudinal direction of the line head 140 is perpendicular to the paper transporting direction. A longitudinal size of the head case 140*a* is larger than a widthwise size of the printing paper P. The width of the printing paper P is perpendicular to the paper transporting direction.

In addition, as shown in FIG. 2, the head case 140*a* is disposed above the belt conveyor on a downstream side of the paper transporting direction compared with the pressing roller 136. Accordingly, the sheet of the printing paper P that is being transported passes below the head case 140*a*.

Further, the head case 140*a* has a slot (not shown) on a side face thereof, and the data cable 143*a* shown in FIG. 2 is inserted into the slot. The CPU 121 transmits data to each control circuit 143 of each line head 140 via the data cable 143*a*.

Printing

Next, printing that is executed by the printing system 1 shown in FIG. 1 will be described below.

In the printing system 1 shown in FIG. 1, first, the PC 10 transmits print data to the printer 100, and the printer 100 receives the print data.

The CPU 121 of the printer 100 generates dot gradation data from the print data. The driving signal generating circuit 124 generates the driving signal COM by using driving waveform data. At this time, the paper transporter 130 feeds a sheet of the printing paper P in the paper feeding tray toward the belt conveyor.

Next, the sheet of the printing paper P is transported by the belt conveyor along the paper transporting direction at constant speed.

While the sheet of the printing paper P is being transported, the line head 140 is driven in response to the driving signal COM. This causes the line head 140 to use the dot gradation data input from the main controller 120 and to discharge ink. Here, ink discharging timing is adjusted to match the revolution speed of the driving roller 132 by the main controller 120. Accordingly, the line head 140 only discharges the ink in a vertically downward direction, whereby an image corresponding to the print data is formed on the sheet of the printing paper P passing below the line head 140. The sheet of the printing paper P on which the image is formed is expelled as a print.

Configuration of Line Head 140 (Heads 141)

Next, the heads 141 shown in FIG. 1 will be described in detail below.

Figure 3:
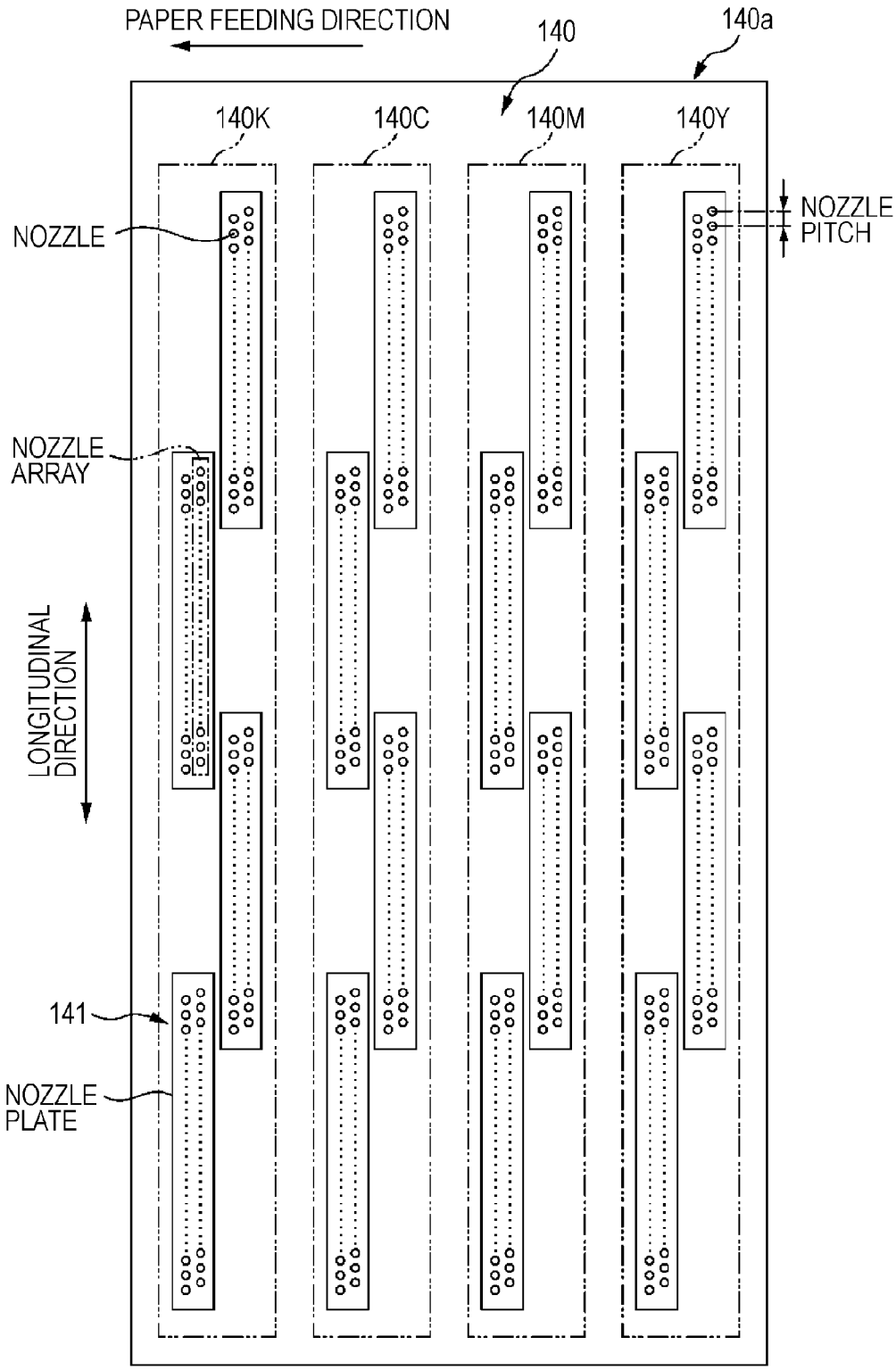
FIG. 3 is a bottom view of the head case shown in FIG. 2.

FIG. 3 is a bottom view showing the head case 140*a* shown in FIG. 2.

In the head case 140*a*, four color head groups 140K, 140C, 140M, and 140Y included in the line head 140 are provided in a form arranged in the paper transporting direction. In each of the head groups 140K, 140C, 140M, and 140Y, four heads 141 are provided in the longitudinal direction shown in FIG. 3 so as to be alternatively arranged in a zigzag manner.

In each head 141, nozzle plates in each of which two nozzle arrays are arranged along the paper transporting direction in FIG. 3 are provided. Each nozzle array includes a plurality of nozzles arranged in the longitudinal direction at a predetermined pitch. Pluralities of nozzles forming two nozzle arrays are disposed, with the plurality on nozzles shifted in the longitudinal direction. In other words, each head 141 includes a plurality of nozzles alternatively arranged in a zigzag manner. This makes is possible to form dots on the sheet of the printing paper P at intervals of a half of the nozzle pitch.

Each nozzle is provided with a cavity (not shown) and the piezoelectric element 142. Deformation in the piezoelectric element 142 changes a pressure in the cavity to discharge ink from the nozzle, and a dot is formed on the sheet of the printing paper P. The piezoelectric element 142 is deformed depending on an applied voltage. A voltage applied to the piezoelectric element 142 is determined by the waveform of the driving signal COM, which will be described below.

Driving Signal COM

Figure 4:
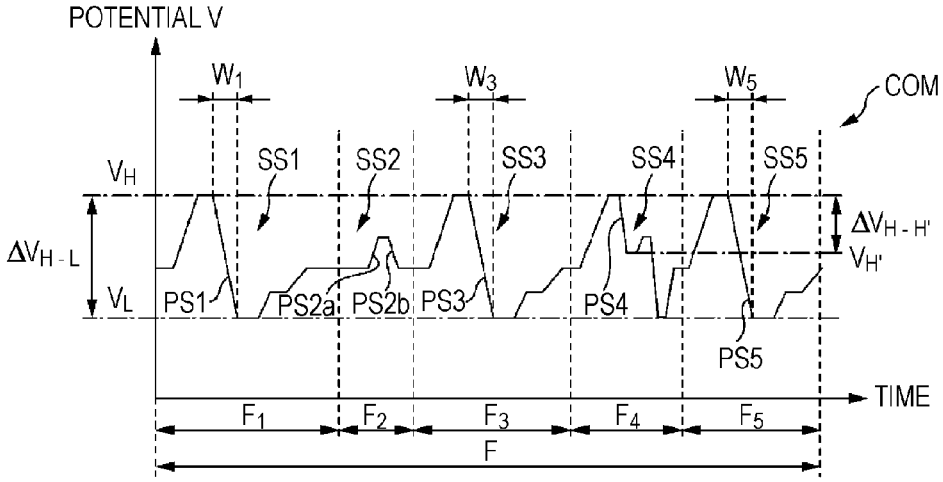
FIG. 4 is a waveform chart illustrating the waveform for one period of a driving signal COM that is input to the control circuit shown in FIG. 1 by the driving signal generating circuit shown in FIG. 1.

FIG. 4 is a waveform chart showing a one-period waveform of a driving signal COM input to the control circuit 143 by the driving signal generating circuit 124.

The driving signal COM, whose waveform is shown in FIG. 4, is generated by one driving signal generating circuit 124 when printing is performed. The generated driving signal COM is input to each of the control circuits 143 of four heads 141 included in one head group. Similarly, driving signals COM are input from each driving signal generating circuit 124 also to other head groups. The period F, shown in FIG. 4, of the driving signal COM corresponds to a time necessary for each piezoelectric element 142 to discharge ink droplets for one pixel through the nozzle. As is described below, each nozzle discharges 0 to 3 ink droplets per pixel. The reason is that, by using 0 to 3 ink droplets, pixel gradation levels are represented by four gradations (gradation values 0 to 3). The one-period driving signal COM is only shown in FIG. 4. However, regarding the actual driving signal COM, the shown waveform is repeated having the period F.

The one-period waveform shown in FIG. 4 is formed by combining five pulses, that is, a pulse SS1 having a period $F_1$, a pulse SS2 having a period $F_2$, a pulse SS3 having a period $F_3$, a pulse SS4 having a period $F_4$, and a pulse SS5 having a period $F_5$. Accordingly, constituent elements constituting each pulse will be described below. In this specification, in the waveform shown in FIG. 4, each point at which a potential changes, and start and end points of each period are called "potential change points", and the "constituent elements" of each pulse are waveforms corresponding to line segments between adjacent potential change points.

The waveforms of the pulses SS1, SS3, and SS5 are identical to one another, and respectively have electric discharge elements PS1, PS3, and PS5 as constituent elements. That "the waveforms are identical" is that "all factors, that is, constituent elements, such as a reference potential, a potential difference, a time width, and a potential change point, constituting each waveform, and timing are completely identical".

The electric discharge element PS1 is necessary for determining an electric discharge period in which the piezoelectric element 142 electrically discharges. This electric discharge period corresponds to a time width $W_1$ between two times (timings) represented by two potential change points determining the electric discharge element PS1. In addition, the magnitude of deformation of the piezoelectric element 142 is determined according to the magnitude of a potential difference $\Delta V_{H-L}$ between a potential $V_H$ (the highest potential of the pulse SS1) and a potential $V_L$ (the lowest potential of the pulse SS1) represented by two potential change points determining the electric charge element PS1. This magnitude of deformation affects the magnitude of change in volume of the cavity, and also affects the size of an ink droplet discharged from the nozzle. In addition, a potential inclination (potential gradient) that represents a potential decrease determined by the time width $W_1$ and potential difference $V_{H-L}$ of the electric discharge element PS1 affects the magnitude of a pressure change in the cavity and affects the size of an ink droplet discharged from the nozzle. As described above, in accordance with the magnitude of the potential difference $V_{H-L}$ of the electric discharge element PS1 and the time width $W_1$ of the electric discharge element PS1, the size (discharge amount) of the ink droplet discharged from the nozzle is determined. The waveforms of the electric discharge elements PS3 and PS5 are identical to that of the electric discharge element PS1. Thus, the electric discharge elements PS3 and PS5 are not described.

Also the electric discharge element PS4 of the pulse SS4 is a waveform necessary for the piezoelectric element 142 to determine an electric discharge period for electric discharging. In accordance with a potential difference $\Delta V_{H-H'}$ between the potential $V_H$ (the highest potential of a pulse SS4) and a potential ($V_{H'}$) (potential represented by a potential change point following a potential change point corresponding to the highest potential $V_H$ of the pulse SS4) that are represented by two potential change points of the electric discharge element PS4, and the time width of the electric discharge element PS4, the size (discharge amount) of the ink droplet discharged from the nozzle is determined. A downward convex waveform including the other electric discharge element of the pulse SS4 is a meniscus suppressing waveform for use in suppressing a meniscus (free surface of ink exposed at the nozzle).

The pulse SS2 includes an accumulation element PS2*a* and an electric discharge element PS2*b*, and is a waveform for the piezoelectric element 142 to micro-vibrate. Micro-vibration of the piezoelectric element 142 stirs the ink in the cavity, thereby suppressing fixation (increased viscosity) of the ink.

The CPU 121 generates data representing a potential change point (the time (timing) and a potential) as driving waveform data, and writes the data in the memory 122. The driving signal generating circuit 124 generates the driving signal COM. The driving signal COM has a waveform corresponding to line segments connecting potential change points represented by the driving waveform data in the order of times (timings).

Driving of Piezoelectric Element 142

The generated driving signal COM is input to the control circuits 143 (see FIG. 1) of four heads 141 (head group) by the CPU 121. The piezoelectric element 142 of each head 141 is driven in response to the driving signal COM. This causes the head 141 to discharge ink.

At this time, the control circuit 143 includes a driving signal switch (gate), and controls a time in which the driving signal COM is input to the piezoelectric element 142. In other words, by controlling an ON/OFF switching operation of the driving signal switch, the control circuit 143 selectively applies the pulses SS1 to SS5 of the driving signal COM to the piezoelectric element 142.

FIGS. 5A to 5D are timing charts showing relationships between a switch operation signal waveform and the waveform of a driving signal input to the piezoelectric element 142. In FIGS. 5A to 5D, the shown dotted lines indicate waveforms of the driving signal COM shown in FIG. 4.

Each switch operation signal shown is used to control turning-on and turning-off of the driving signal switch that controls input of the driving signal COM to the piezoelectric element 142. In the control circuit 143, in a period in which the switch operation signal is in a high level (H), the driving signal switch is turned on, whereby the driving signal COM is input to the piezoelectric element 142, while, in a period in which the switch operation signal is in a low level (L), the driving signal switch is turned off, whereby input of the driving signal COM to the piezoelectric element 142 is cut off.

Figure 5A:
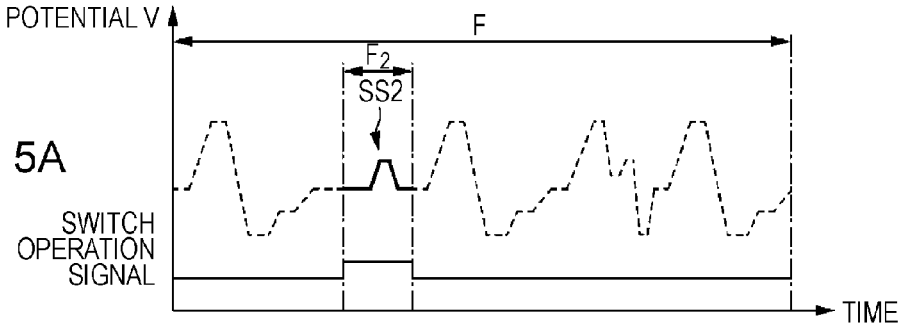
Figure 5B:
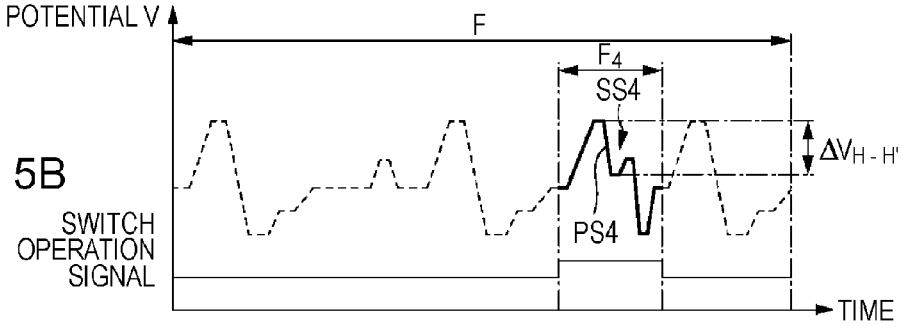
Figure 5C:
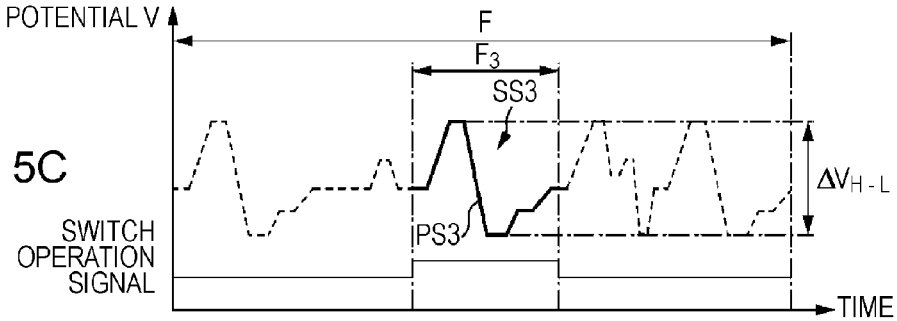
Figure 5D:
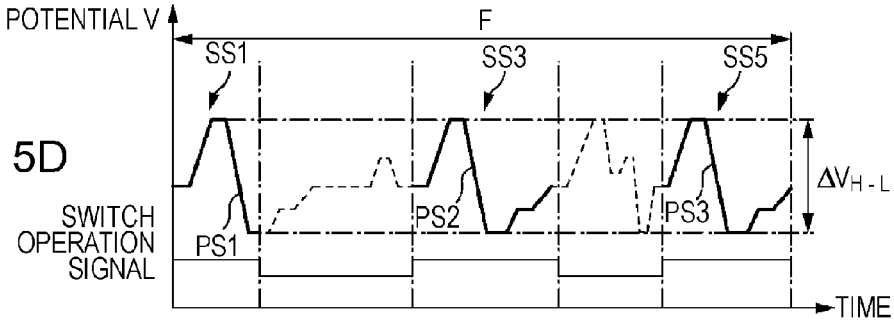

In a case where the gradation value of a pixel is "0", as shown in FIG. 5A, the pulse SS2 is applied to the piezoelectric element 142 to perform micro-vibration, and an ink droplet is not discharged, so that no dot is formed for the pixel. In addition, in a case where the gradation value of a pixel is "1", as shown in FIG. 5B, the pulse SS4 is applied to the piezoelectric element 142, whereby approximately 2.0 pL (=$2.0\times 10^{-15}$ $m^3$) of an ink droplet is discharged from the nozzle, so that a dot (small dot) is formed for the pixel. In addition, in a case where the gradation value of a pixel is "2", as shown in FIG. 5C, the pulse SS3 is applied to the piezoelectric element 142, whereby approximately 7.0 pL of an ink droplet is discharged from the nozzle, so that a dot (middle dot) is formed for the pixel. In addition, in a case where the gradation value of a pixel is "3", as shown in FIG. 5D, the pulses SS1, SS3, and SS5 are applied to the piezoelectric element 142, whereby a total of approximately 21.0 pL of (three) ink droplets is discharged, so that a dot (large dot) is formed for the pixel.

The gradation value of each pixel is determined by dot gradation data generated from print data. In other words, the control circuit 143 (see FIG. 1) controls an ON/OFF switching operation of each driving signal switch on the basis of dot gradation data from the main controller 120, whereby an ink droplet having a size in accordance with a gradation value represented by the dot gradation data is discharged and a dot having the size in accordance with the gradation value represented by the dot gradation data is formed for each pixel. As described above, the dot gradation data representing the gradation of a dot (pixel) is also data representing the size of an ink droplet that each head 141 is caused to discharge. Thus, the dot gradation data corresponds to discharge data.

Temperature Change of Viscosity of Ink

Next, ink used in the printer 100 will be described below.

Figure 6:
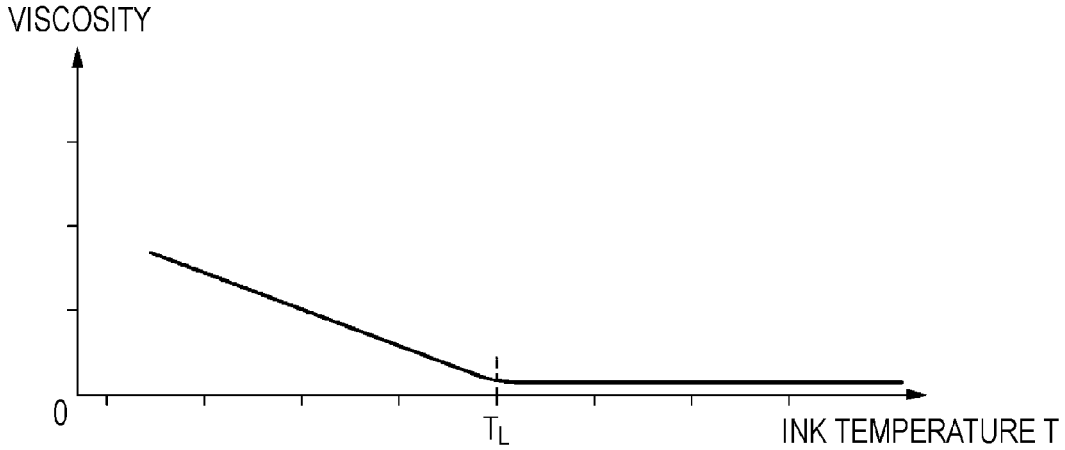
FIG. 6 is a schematic graph showing a characteristic of black ink.

FIG. 6 is a schematic graph showing characteristics of black ink. The vertical axis of the graph in FIG. 6 indicates ink viscosity (any units), and the horizontal axis of the graph in FIG. 6 indicates an ink temperature T (any units). The characteristics of the black ink in FIG. 6 are obtained beforehand as an experimental result. Data of the characteristics of the black ink is written in the memory 122 in FIG. 1.

As shown in FIG. 6, the lower the ink temperature T, the higher the viscosity of the black ink. On the other hand, the higher the ink temperature T, the lower the viscosity of the black ink (first characteristic).

In addition, as shown in FIG. 6, the curve indicating the characteristics of the black ink remain approximately unchanged in a high temperature region of the ink temperature T (in a case where the ink temperature T is equal to or higher than the viscosity-stability-lower-limit temperature $T_L$ shown in FIG. 6). Such a high temperature region is hereinafter referred to as a "viscosity-stability-temperature region". Regarding the black ink, in a case where the ink temperature T is within the viscosity-stability-temperature region, even if a temperature difference of the ink temperature T is large, it is difficult for an amount of change in viscosity to increase (stable viscosity). In addition, in a case where the ink temperature T is within a low temperature region, as a temperature difference of the ink temperature T increases, the amount of change in viscosity easily increases (unstable viscosity). The black ink has this characteristic (second characteristic).

The cyan ink, the magenta ink, and the yellow ink that are contained in the ink packs 151C, 151M, and 151Y also have characteristics similar to the first and second characteristics of the black ink. Data of these inks is written in the memory 122.

The above-described heater 160 is installed for the purpose of supplying each head 141 with ink whose viscosity is as stable as possible. Accordingly, by the time the heater 160 is installed, the viscosity-stability-temperature region of ink is set in view of the second characteristic, and, within the viscosity-stability-temperature region, a heat reserving temperature $T_o$ is set. Since a change in the viscosity of the ink in each head 141 affects a discharge amount (size) of an ink droplet, if the temperature of the ink in the head 141 is within the viscosity-stability-temperature region, the discharge amount of the ink droplet can be easily maintained.

Natural Cooling of Ink and Influence thereof

Figure 7:
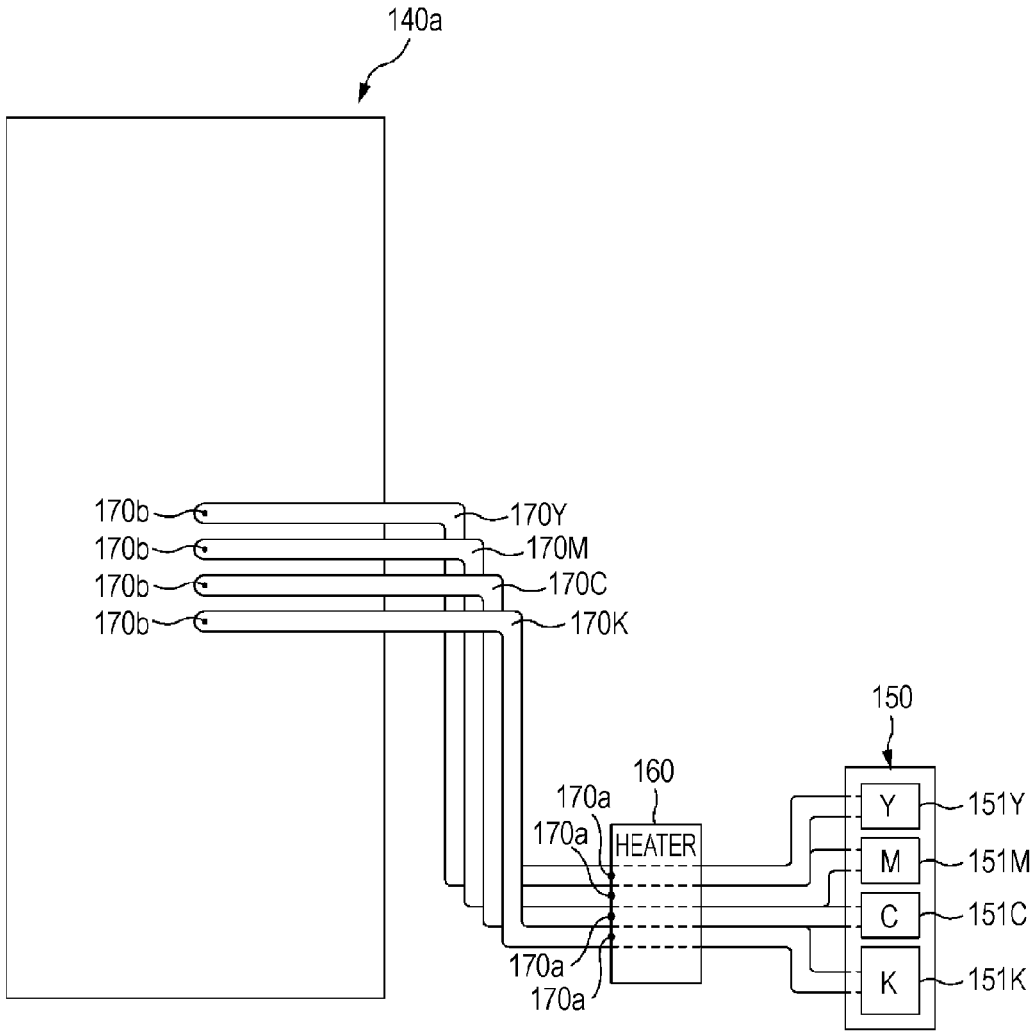
FIG. 7 a schematic top view showing the arrangement of the tubes shown in FIG. 1.

FIG. 7 is a schematic top view showing an arrangement of the tubes 170K, 170C, 170M, and 170Y shown in FIG. 1. FIG. 7 also shows the ink tank 150 and heater 160 shown in FIG. 1, and the head case 140*a* shown in FIG. 2.

As shown in FIG. 7, the tube 170K connects the ink pack 151K of the ink tank 150 and a corresponding head 141 (not shown in FIG. 7) of the head case 140*a*. The heater 160 is disposed between the ink tank 150 and the head case 140*a*. The tube 170K passes through a heating region of the heater 160. The reason that the heater 160 is not disposed in the head case 140*a* is that space in the head case 140*a* is insufficient.

The black ink supplied from the ink pack 151K flows into the tube 170K. First, the temperature of the flowing black ink is adjusted to the heat reserving temperature $T_o$ of the heater 160. Next, the black ink passes through the heating region of the heater 160 at one heater passage position 170*a* shown in FIG. 7. The ink temperature T of the black ink at the heater passage position 170*a* is equal to the heat reserving temperature $T_o$ of the heater 160. After that, the black ink flowing in the tube 170K passes through a head case contact 170*b*. The head case contact 170*b* is a position in the tube 170K that corresponds to a position at which the tube 170K is inserted into a hole in an upper face of the head case 140*a*.

After the black ink passes through the heater passage position 170*a*, its temperature is not adjusted by the heater 160, so that the black ink naturally cools. In the first embodiment, it is considered that the black ink naturally cools in a section from the heater passage position 170*a* to the head case contact 170*b*.

Natural cooling of the black ink decreases the temperature of the black ink, thereby increasing the viscosity of the black ink. If each piezoelectric element 142 in the head 141 is similarly driven despite an increase in the viscosity of the black ink, the amount of the black ink droplets discharged from the nozzle decreases in accordance with the increase in viscosity of the black ink. This causes variations in size of dots formed on the printing paper P, so that image quality deteriorates.

Overview of First Embodiment

The ink temperature decreased by natural cooling is related to a total amount of ink flowing in the tubes 170K, 170C, 170M, and 170Y. For example, when the total amount of inks flowing in the tubes 170K, 170C, 170M, and 170Y is less, the travel time from after the inks pass through the heater 160 until the inks arrive at the heads 141 is long to increase a heat release. Thus, the temperature of the inks when they have arrived at the heads 141 is low. In addition, when the total amount of inks flowing in the tubes 170K, 170C, 170M, and 170Y is large, the travel time from after the inks pass through the heater 160 until the inks arrive at the heads 141 is short to reduce a heat release. Thus, the temperature of the inks when they have arrived at the heads 141 remains relatively high.

Accordingly, in the first embodiment, in response to a flow amount of the inks flowing in the tubes 170K, 170C, 170M, and 170Y, the driving signal COM is altered, whereby the discharge amount of ink droplets discharged is constant. For example, when the flow amount of the inks flowing in the tubes 170K, 170C, 170M, and 170Y is less, the temperature of the inks in the heads 141 is low to increase the ink viscosity. Thus, the driving signal COM is altered so that the discharge amount of ink droplets increases.

In order to realize this control, the first embodiment performs the following processing.

First, the main controller 120 calculates a flow amount of inks flowing in the tubes 170K, 170C, 170M, and 170Y. The flow amount of inks flowing in the tubes 170K, 170C, 170M, and 170Y is equal to a discharge amount of inks discharged from the heads 141. Thus, the main controller 120 calculates the discharge amount of inks by using dot gradation data, and determines the flow amount of inks flowing in the tubes 170K, 170C, 170M, and 170Y. In addition, the main controller 120 stores a history of the calculated flow amount of inks (the CPU 121 writes the history in the memory 122).

Next, the main controller 120 calculates the travel time from after the inks pass through the heater 160 until the inks arrive at the heads 141. In other words, the main controller 120 calculates how old the inks having arrived at the heads 141 are after passing through the heater 160. That is, the main controller 120 calculates a natural cooling time of inks until the inks arrive at the heads 141. At this time, the main controller 120 calculates the travel time by using the history of the flow amount of inks.

Next, the main controller 120 calculates the ink temperature in the head 141. The ink temperature in the head 141 is calculated on the basis of ink temperatures at the heater passage positions 170*a*, the outside air temperature $T_{air}$, and the calculated travel time.

The main controller 120 alters the driving signal COM in response to the ink temperature in the head 141. In the first embodiment, the magnitudes of the potential difference $V_{H-L}$ and potential difference $V_{H-H'}$ (hereinafter referred to as a "potential difference ΔV") of the driving signal COM shown in FIG. 4 are altered. In the case of altering the magnitude of the potential difference ΔV, also the magnitude of the potential difference of the pulse SS2 shown in FIGS. 4 and 5A is altered in accordance with the magnitude of potential difference ΔV, whereby the degree of an effect of suppressing an increase in ink viscosity is changed. In addition, in the case of altering the magnitude of potential difference $V_{H-H'}$, also the magnitude of a potential difference of the meniscus suppressing waveform of the pulse SS4 shown in FIGS. 4 and 5B is altered in accordance with potential difference $V_{H-H'}$, whereby the degree of the suppressing effect is altered. The main controller 120 alters the magnitude (waveform) of the potential difference ΔV of the driving signal COM by altering driving waveform data that is used when the driving signal generating circuit 124 generates the driving signal COM.

By performing the above control, deterioration in image quality can be suppressed while maintaining a state in which the discharge amount of ink droplets is not changed.

The first embodiment does not consider natural cooling after the inks arrive at the head case 140*a* (head case contacts 170*b*). In other words, in the first embodiment, the ink temperature at each head case contact 170*b* is regarded as being equal to the ink temperature at the nozzle.

Module Configuration

Figure 8:
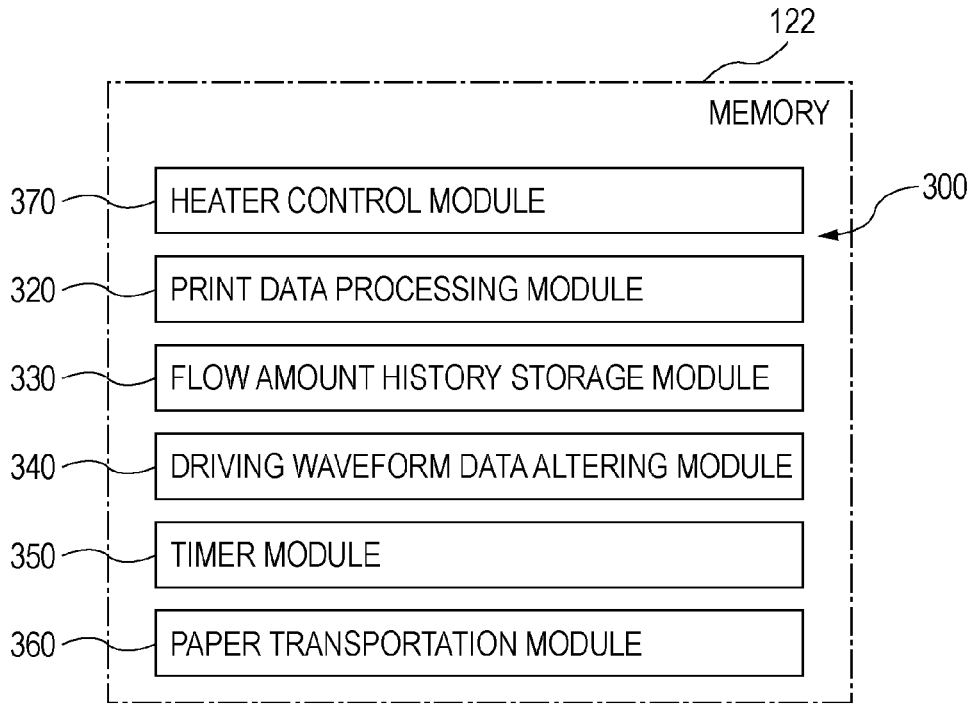
FIG. 8 is a schematic block diagram showing the configuration of modules of the printer shown in FIG. 1.

FIG. 8 is a schematic block diagram showing a module configuration of the printer 100 shown in FIG. 1.

A plurality of modules (program units) included in the module group 300 shown in FIG. 8 are written in the memory 122. The CPU 121 reads and executes the program of each module, whereby each function of the printer 100 according to the embodiment is realized.

The module group 300 includes a print data processing module 320, a flow amount history storage module 330, a driving waveform data altering module 340, a timer module 350, a paper transportation module 360, and a heater control module 370.

The heater control module 370 is a program unit for controlling the heater 160. The CPU 121 uses the heater control module 370 to perform switching on and off and management of a power supply for the heater 160, and to maintain a surface temperature of the heater 160 to the heat reserving temperature $T_o$.

The print data processing module 320 is a program unit for processing the print data in the memory 122. By using the print data processing module 320, the CPU 121 generates dot gradation data by color from the print data, transmits the dot gradation data written in the memory 122 to a corresponding head 141.

The flow amount history storage module 330 is a program unit for causing the main controller 120 to store the history (flow amount data) of a flow amount of ink flowing at each head case contact 170*b*. By using the flow amount history storage module 330, the CPU 121 performs a flow amount data creating process (described later), etc. In the first embodiment, for each color corresponding to each head group, that is, four types of flow amount data are created and stored.

The driving waveform data altering module 340 is a program unit for altering the driving waveform data. By using the driving waveform data altering module 340, the CPU 121 performs the driving waveform data altering process (described later). Here, the driving waveform data is used when the driving signal COM is generated. In the first embodiment, the number of driving signal generating circuits 124 that each generate the driving signal COM by using the driving waveform data is four according to the number of head groups. Thus, there are four types of driving waveform data.

The timer module 350 is a timer for measuring 10 seconds when the flow amount data is created and when driving waveform data is altered.

The paper transportation module 360 is a program unit for driving the paper transporter 130. By using the paper transportation module 360, the CPU 121 transmits a paper feeding motor driving signal (PF DRV) to the paper feeding motor 131 in order to control the paper feeding motor 131 in the paper transporter 130.

In addition, in the memory 122, various types of data (not shown) are written by the CPU 121. The data written in the memory 122 is loaded into the CPU 121, if necessary.

The data written in the memory 122 and data to be written in the memory 122 include print data received by the printer 100 from the PC 10, dot gradation data by color that is generated by print data, driving waveform data for use in generating the driving signal COM, data of the outside air temperature $T_{air}$ detected by the thermistor 125, data representing the heat reserving temperature $T_o$ be set in the heater 160, data representing the volume (path volume C) of one tube after ink passes through the heater 160 (heater passage position 170*a*) until the ink arrives at a corresponding head case contact 170*b*, and data (T–ΔV data) (FIG. 12), obtained beforehand by an experiment, representing a relationship between the ink temperature T and the potential difference ΔV.

Next, processing that is executed by the CPU 121 shown in FIG. 1 using the module group 300 shown in FIG. 8, and that is characteristic in the first embodiment will be described below. The processing that is characteristic in the first embodiment is broadly divided into two: a flow amount data creating process and a driving waveform data altering process.

Flow Amount Data Creating Process

First, the flow amount data creating process will be described below.

The flow amount data creating process includes a counting process that acquires a count value (described later) from the dot gradation data, and a total volume calculating process that calculates a total volume on the basis of the count value. Accordingly, the module group 300 includes by-gradation-level counters (not shown) and a total volume calculating module (not shown). By using these, the CPU 121 executes the counting process and the total volume calculating process.

In the counting process, from dot gradation data output to each control circuit 143, the CPU 121 counts the number of pixels that corresponds to the dot gradation data by pixel gradation value. At this time, the by-gradation-level counters are used.

During the counting process, on the basis of the dot gradation data, the CPU 121 counts a count value X of pixels corresponding to the gradation value "3", a count value Y of pixels corresponding to the gradation value "2", and a count value Z of pixels corresponding to the gradation value "1".

Whenever ten seconds elapse, the CPU 121 writes the count values X, Y, and Z in the memory 122. After finishing the writing, the count values X, Y, and Z are reset. To measure ten seconds for each count value, the timer module 350 is used.

Immediately before the count values X, Y, and Z are reset, the CPU 121 performs the total volume calculating process by using the total volume calculating module. Accordingly, the total volume calculating process is executed every ten seconds. In the total volume calculating process, a total volume $Q_v$ [pL] of ink is calculated on the basis of the following expression using the count values X, Y, and Z. In the following expression, coefficients of the count values X, Y, and Z correspond to ink discharge amounts [pL] corresponding to gradation values.

$$Q_v=21.0\times X+14.0\times Y+2.0\times Z \quad (1)$$

A history of the total volume $Q_v$ calculated on the basis of expression (1) is written in the memory 122 (is stored in the main controller 120). After the writing finishes, the total volume $Q_v$ is cleared. The total volume $Q_v$ calculated in this process corresponds to the amount of ink used for 10 seconds that is calculated by using dot gradation data output to the control circuits 143 of one head group. In addition, since the total volume $Q_v$ is obtained for 10 seconds, the total volume $Q_v$ corresponds to a volumetric flow Q (=$Q_v$ [pL]/10 [s]) of the nozzle. The volumetric flow Q also corresponds to a volumetric flow Q of ink flowing through one head case contact 170*b*.

As described above in detail, according to the flow amount data creating process, from dot gradation data, the main controller 120 can store the volumetric flow Q of ink flowing through one head case contact 170*b* every ten seconds, and can store the history of the volumetric flow Q.

Flow Amount Data

Figure 9:
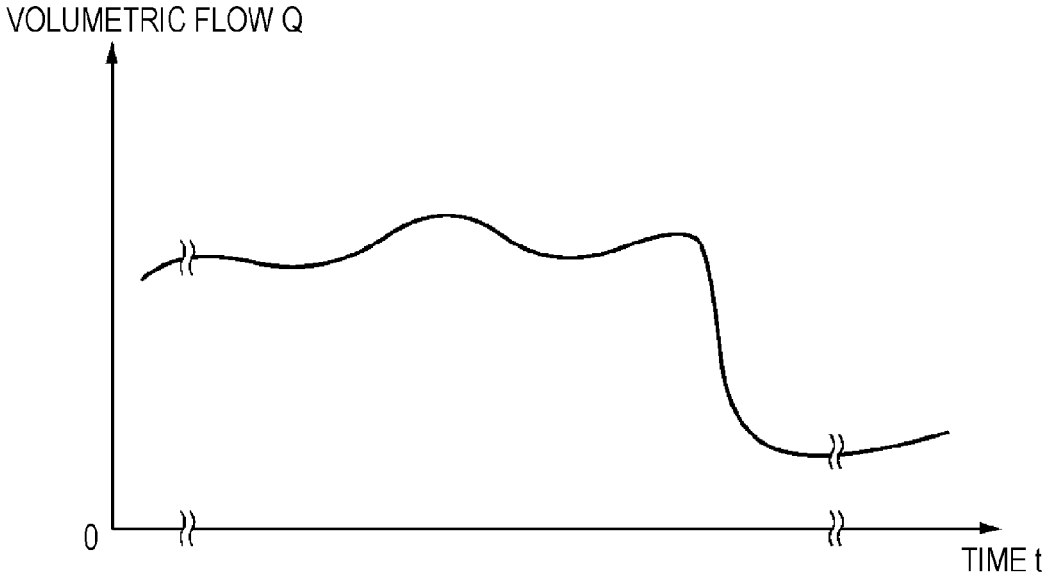
FIG. 9 is a schematic graph showing part of a history of an ink flow amount stored in the main controller shown in FIG. 1.

FIG. 9 is a schematic graph showing part of the history (flow amount data) of the ink flow amount stored in the main controller 120. In FIG. 9, the vertical axis indicates a value represented by the volumetric flow Q in the history, and the horizontal axis indicates time t. Although, in FIG. 9, the history (flow amount data) of the volumetric flow Q is drawn as a smooth curve, actually, it is a set of data obtained every ten seconds.

The flow amount data shown in FIG. 9 was created during a printing period. As shown in FIG. 9, during the printing period, the value of the volumetric flow Q varied, so that the printing period included a period in which the value of the volumetric flow Q was relatively large and a period in which the value of the volumetric flow Q was relatively small.

In the period in which the value of the volumetric flow Q was relatively small, the amount of ink used was less. In this period, until ink having passed through one heater passage position 170*a* arrives at a corresponding head case contact 170*b*, a time was relatively taken. In addition, in the period in which the volumetric flow Q was relatively large, the amount of ink used was large. In this period, until ink having passed through one heater passage position 170*a* arrived at a corresponding head case contact 170*b*, a time was not relatively taken.

Driving Waveform Data Altering Process

Next, the driving waveform data altering process will be described below. Here, the driving waveform data concerning the black ink (the head group 140K) is exemplified.

Figure 10:
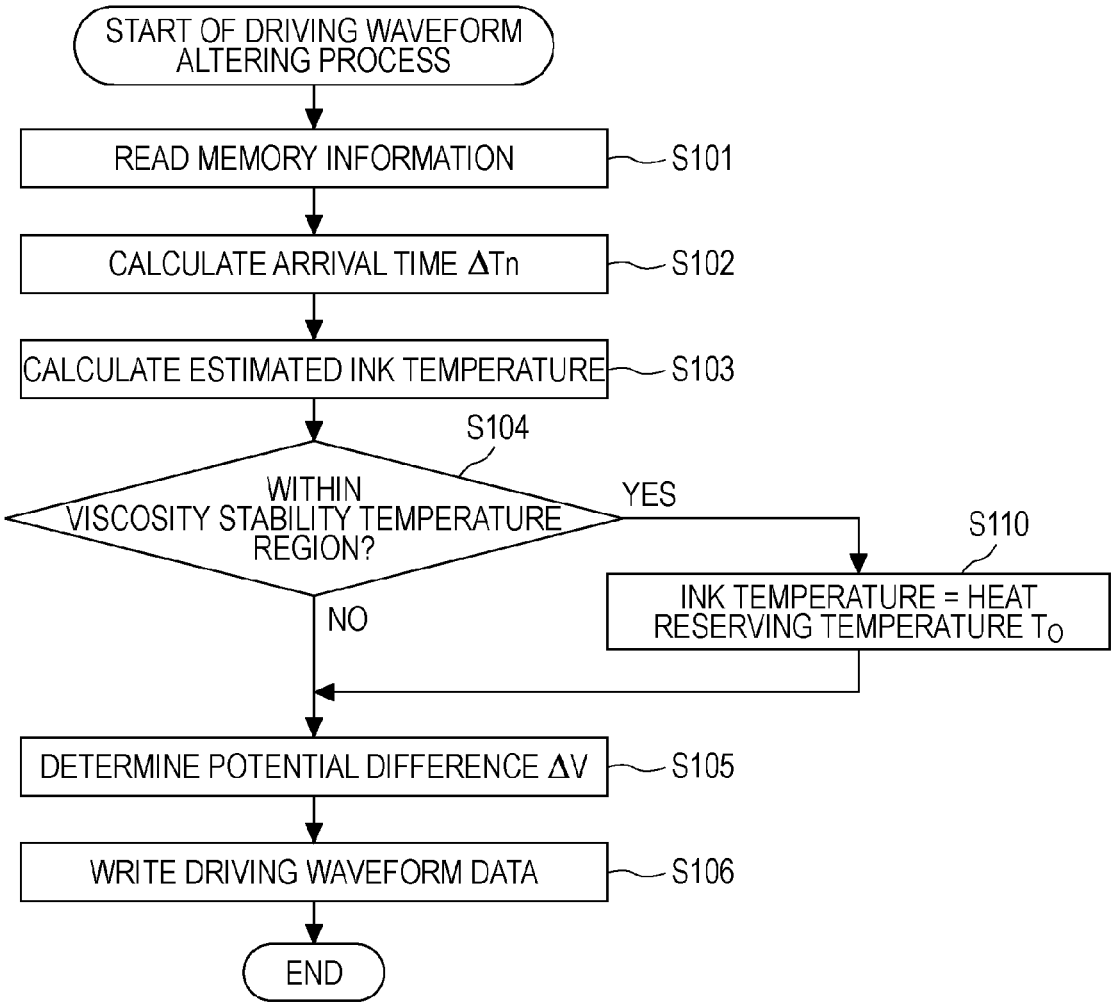
FIG. 10 is a flowchart showing a driving waveform data altering process executed by the printer shown in FIG. 1.

FIG. 10 is a flowchart showing the driving waveform data altering process executed by the printer 100 shown in FIG. 1. This process is executed by the CPU 121, using the driving waveform data altering module 340 shown in FIG. 8. In addition, the driving waveform data altering process is executed every ten seconds. To measure ten seconds, the CPU 121 uses the timer module 350.

Referring to FIG. 10, first, in step S101, the data written in the memory 122 is read. The data to be read includes flow amount data created in the flow amount data creating process, data representing the path volume C, data representing the heat reserving temperature $T_o$ of the heater 160, the outside air temperature $T_{air}$, and T–ΔV data.

In step S102, a travel time $\Delta t_n$ is calculated using flow amount data of the black ink. Since the flow amount data is used, the travel time $\Delta t_n$ can be calculated without touching the black ink. The travel time $\Delta t_n$ is a time taken until the black ink having passed through the heater passage position 170*a* of the tube 170K arrives at the head case contact 170*b*. In step S103, subsequently, by using the calculated travel time $\Delta t_n$, the ink temperature of the black ink arriving at the head case contact 170*b* is calculated, and the ink temperature is acquired as an estimated ink temperature T'. As described above, the travel time $\Delta t_n$ and the estimated ink temperature T' can be calculated in a noncontact manner without touching the black ink.

In step S104, it is determined whether or not the estimated ink temperature T' is within the viscosity-stability-temperature region. The determination in step S104 indicates that the estimated ink temperature T' is not within the viscosity-stability-temperature region, it is determined that the black ink at the head case contact 170*b* and the nozzle has a high viscosity of black ink (unstable viscosity) (see FIG. 6). In this case, in step S105, from the "ink temperature–potential difference ΔV" data (FIG. 12), a potential difference ΔV corresponding to the estimated ink temperature T' is determined (specified). At this time, in accordance with the magnitude of the determined potential difference ΔV, the magnitude of the pulse SS2 shown in FIGS. 4 and 5A is determined, and, in accordance with the magnitude of the potential difference $V_{H-H'}$, also the magnitude of a potential difference of the meniscus suppressing waveform of the pulse SS4 shown in FIGS. 4 and 5B is determined.

In step S106, the CPU 121 specifies a potential change point corresponding to the determined potential difference ΔV or the like, and writes, in the memory 122, driving waveform data representing all potential change points including the specified potential change point. This reflects the determined potential difference ΔV in the driving waveform data. The driving waveform data is generated in order to drive the four heads 141 included in the head group 140K. Whenever the writing is performed, the driving waveform data is altered. After that, the driving waveform data altering process finishes.

If the estimated ink temperature T' is within the viscosity-stability-temperature region (YES in step S104) it is determined that a heat release of the black ink needs to be small since the value of the travel time $\Delta t_n$ is small, and it is determined that the black ink at the head case contact 170*b* and the nozzle has a sufficiently low viscosity (stable viscosity) of black ink (see FIG. 6). In this case, in step S110, the CPU 121 uses the heat reserving temperature $T_o$ of the heater 160 instead of the calculated estimated ink temperature T', and performs steps S105 and S106. The value of the potential difference ΔV determined at this time is the potential difference $\Delta V_o$ shown in FIG. 12.

According to the process in FIG. 10, the travel time $\Delta t_n$ is calculated (step S102) using the flow amount data, and the estimated ink temperature T' is calculated using the travel time $\Delta t_n$ (step S103). If the estimated ink temperature T' is not within the viscosity-stability-temperature region of the black ink (NO in step S104), the potential difference ΔV corresponding to the estimated ink temperature T' is determined (step S105), and driving waveform data in which the determined potential difference ΔV is reflected is written in the memory 122 (step S106). Since the driving waveform data altering process is performed every ten seconds, the driving waveform data to be written in the memory 122 is altered whenever ten seconds elapse.

After that, the driving signal generating circuit 124 generates the driving signal COM, which corresponds to line segments connecting potential change points represented by the driving waveform data in the order of times, in order to drive the four heads 141 included in the head group 140K. Also the waveform of the driving signal COM (and a driving signal input to each piezoelectric element 142 by the control circuit 143) is altered whenever the driving waveform data is altered.

In addition, if the estimated ink temperature T' is within the viscosity-stability-temperature region (YES in step S104), the potential difference $\Delta V_o$, which has the same value, is used. In this case, even if the driving waveform data is updated, the waveform of the driving signal COM is identical to that of the driving waveform data before being updated. That is, if the estimated ink temperature T' is within the viscosity-stability-temperature region, the waveform of the driving signal COM (and the driving signal input to each piezoelectric element 142 by the control circuit 143) is not substantially altered. This is because, in a case where the ink temperature is within the viscosity-stability-temperature region, the amount of change of the black ink is small (see FIG. 6). It is noted that, when it is necessary to alter the potential difference ΔV even if the estimated ink temperature T' is within the viscosity-stability-temperature region, steps S104 and S110 may be omitted in the driving waveform data altering process shown in FIG. 10.

Calculation of Travel Time $\Delta t_n$

Figure 11A:
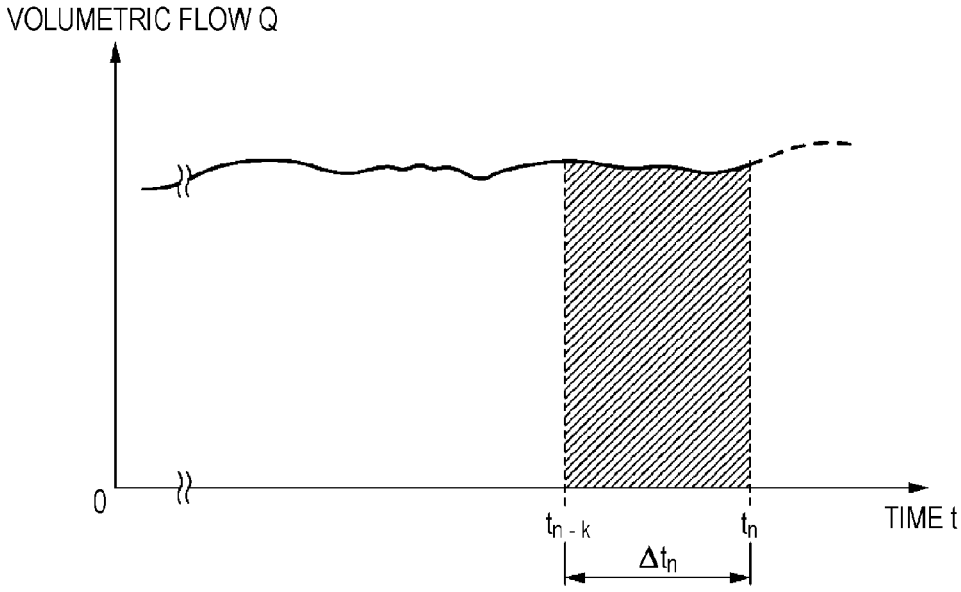

FIG. 11A is a graph illustrating the travel time $\Delta t_n$ that is calculated in travel time calculation in step S102. The solid line shown in FIG. 11A indicates flow amount data.

In travel time calculation, the travel time $\Delta t_n$ of ink having arrived at the head case contact 170*b* at time T, is calculated. To calculate the travel time $\Delta t_n$, in the first embodiment, integration (accumulation) of the flow amount data is performed. In each of FIGS. 11A and 11B, "n" that is used as an index of time t represents a flow amount data number at intervals of 10 seconds, and "k" and "j" are integers less than "n".

The hatched part shown in FIG. 11A indicates an integration region based on integration.

The integration is performed from time $T_n$ in a direction opposite to a time-axial direction (so as to go back flow amount data in the past). The integration is performed until an integrated value is equal to the path volume C. Since the flow amount data at intervals of ten seconds, the integrated value may be slightly larger than the path volume C. This determines an end point $t_{n-k}$ of the integration. During the time from the end point $t_{n-k}$ of the integration to time $T_n$, the quantity of ink that is equal to the path volume C is discharged from the four heads 141 included in each head group.

Next, a time that is a difference from time $T_n$ to time $t_{n-k}$ is determined. This time corresponds to a discharge time. The discharge time is the time required for ink having a volume equal to the path volume C to be discharged from the nozzle on or before time $T_n$. The discharge time is also equal to a travel time $\Delta t_n$. A travel time $\Delta t_n$ is the time required after ink at the heater passage position 170*a* begins to flow at time $t_{n-k}$ until the ink arrives at the head case contact 170*b* at time $T_n$.

Figure 11B:
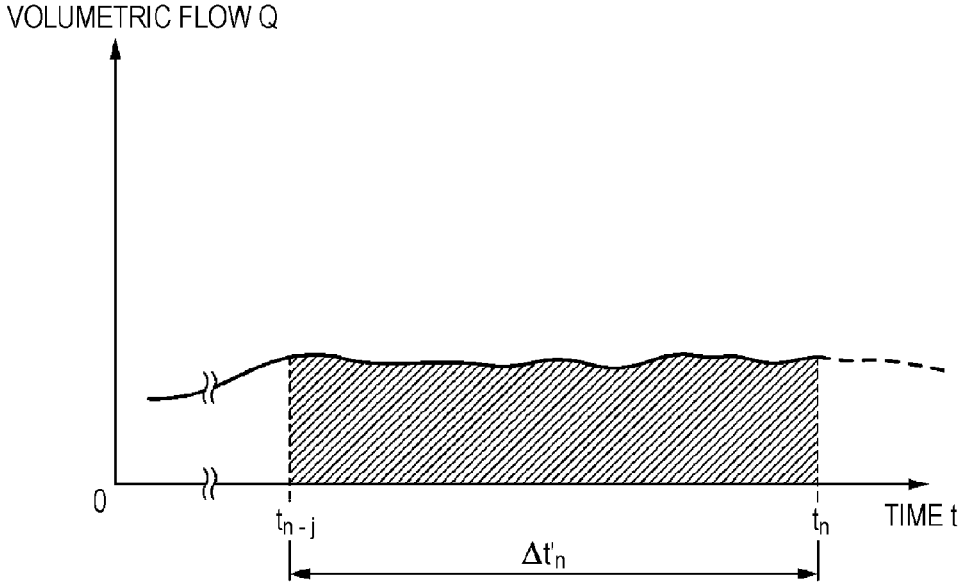
FIG. 11B shows flow amount data obtained when a flow amount is less than that in FIG. 11A.

FIG. 11B is a graph illustrating a travel time in a case where a flow amount is less than that in the case of FIG. 11A. Also in this case, similarly to the case of FIG. 11A, the travel time is calculated. As shown in FIG. 11B, a travel time $\Delta t'_n$ in the case where the flow amount is less is longer than the travel time $\Delta t_n$ in the case of FIG. 11A.

Estimation of Ink Temperature

Next, the ink temperature calculation executed in step S103 in FIG. 10 will be described in detail.

First, ink having the temperature adjusted to the heat reserving temperature $T_o$ by the heater 160 naturally cools after the ink begins to flow at the heater passage position 170*a* until the ink arrives at the head case contact 170*b*. The natural cooling causes the ink temperature of the ink to be close to the outside air temperature $T_{air}$. A state of the decrease in ink temperature is represented by $$T(\Delta t)=T_o+(T_{air}-T_o)\times(1-e^{-\Delta t/a}) \quad (2)$$

where $T(\Delta t)$ is an ink temperature obtained after a certain time Δt elapses.

In expression (2), the coefficient "a" is a value that is determined by a material quality and sectional area (surface area) of a material for each of the tubes 170K, 170C, 170M, and 170Y, and that is obtained beforehand by an experiment. The value of the coefficient a represents the degree of a heat release of the tube 170K, and is written in the memory 122 beforehand.

In the ink temperature calculation (step S103), by substituting the travel time $\Delta t_n$ calculated in step S102 for the time Δt in expression (2), an estimated ink temperature $T(\Delta t_n)$ is calculated. The CPU 121 acquires the estimated ink temperature T ($\Delta t_n$) as an estimated ink temperature T' of ink flowing in the head case contact 170*b*. The first embodiment does not consider natural cooling after the ink arrives at the head case 140*a*. Thus, the estimated ink temperature T' also corresponds to an ink temperature in the head 141.

The estimated ink temperature T' obtained in the estimation of the ink temperature is used in the potential difference determination in step S105 in FIG. 10.

Determination of Potential Difference ΔV

Figure 12:
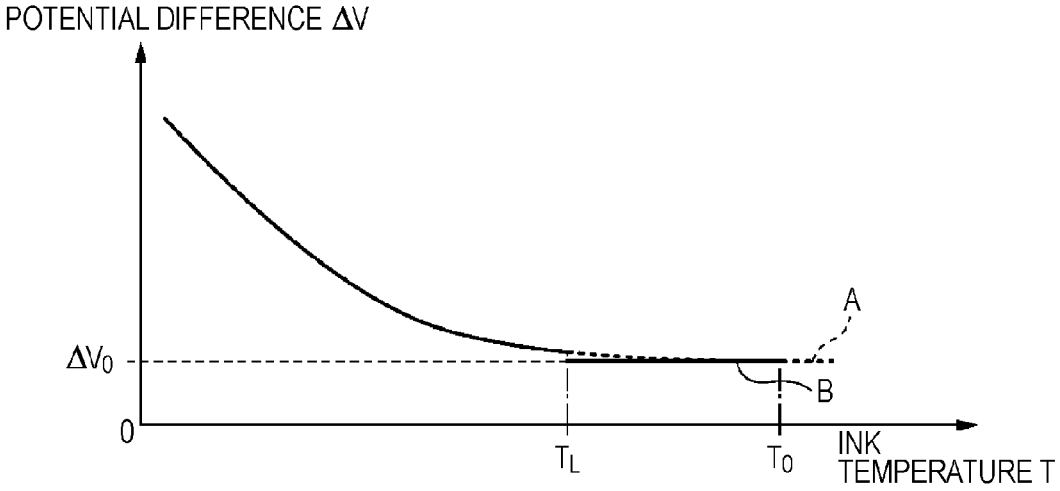
FIG. 12 is a schematic graph showing "T−ΔV" data for use in the potential difference determination in step S105 in FIG. 10.

FIG. 12 is a schematic graph showing "T−ΔV" data for use in the potential difference determination in step S105 in FIG. 10. In FIG. 12, in a range in which the ink temperature T is equal to or less than the viscosity-stability-lower-limit temperature $T_L$, a dotted line A and a solid line B overlap each other.

The "T−ΔV" data indicated by the solid line A in FIG. 12 represents a relationship between the ink temperature T and potential difference ΔV. For details, the "T−ΔV" data represents a relationship between the ink temperature T and the potential difference ΔV when the quantity of ink droplets discharged per pixel through the nozzle is maintained at a target quantity. The target quantity is set in accordance with a gradation value of a pixel. For example, when the gradation value of a pixel is "1", the target quantity is 2.0 pL, and, when the gradation value of a pixel is "2", the target quantity is 7.0 pL.

According to the dotted line A in FIG. 12, the higher the ink temperature T, the smaller the potential difference ΔV necessary for maintaining the amount of ink droplets at the target quantity, while, the lower the ink temperature T, the larger the potential difference ΔV necessary for maintaining the amount of ink droplets at the target quantity. Therefore, by knowing the ink temperature T, the potential difference ΔV necessary for maintaining the amount of ink droplets at the target quantity can be determined from FIG. 12.

Accordingly, in the first embodiment, from the estimated temperature T($\Delta t_n$) and the heat reserving temperature $T_o$ of the heater 160, the value of the potential difference ΔV is determined on the thick solid line B shown in FIG. 12 (step S105). Specifically, if the estimated temperature T($\Delta t_n$) is not within the viscosity-stability-temperature region, the value of the potential difference ΔV is determined on the basis of the estimated temperature T ($\Delta t_n$).

The "T−ΔV" data indicated by the thick solid line B shown in FIG. 12 includes data relating to the potential difference $V_{H-L}$ and data relating to potential difference $V_{H-H'}$. Both are written in the memory 122. In addition, in the memory 122, data representing the magnitude of a potential difference of the pulse SS2 in accordance with the potential difference ΔV, and data representing the magnitude of a potential difference of the meniscus suppressing waveform of the pulse SS4 in accordance with the potential difference $V_{H-H'}$ are also written.

Advantages of First Embodiment

As described above with reference to FIGS. 8 to 12, in the first embodiment, the main controller 120 creates flow amount data, calculates a travel time $\Delta t_n$ from the flow amount data, calculates an estimated temperature T($\Delta t_n$) from the travel time $\Delta t_n$, and determines a potential difference ΔV from the estimated temperature T($\Delta t_n$). After that, the main controller 120 writes, in the memory 122, driving waveform data representing all potential change points including a potential change point according to the determined potential difference ΔV. Subsequently, the driving signal generating circuit 124 generates a driving signal COM having a waveform corresponding to line segments connecting the potential change points represented by the driving waveform data, and inputs the driving signal COM to a head group of a corresponding color. In other words, in the first embodiment, the main controller 120 alters the driving waveform data in accordance with the flow amount of ink flowing in each tube, and alters the waveform of the driving signal COM (and the driving signal input to the piezoelectric element 142 by the control circuit 143 of the corresponding head group). By driving the piezoelectric element 142 with the driving signal having the altered waveform, the amount of ink droplets per pixel can be maintained at a target quantity. This processing is performed in the first embodiment for each head group (each color). In each head group, a driving signal for driving four heads is the same. The head group corresponds to a head that is driven in response to the driving signal to discharge ink.

If the amount of ink droplets per pixel is maintained at the target quantity, the sizes of dots formed on the printing paper P have no variations. Therefore, according to the printer 100 according to the first embodiment, deterioration in image quality due to occurrence of variation in dot size can be suppressed.

Flow Amount Except for Printing Period

Figure 13A:
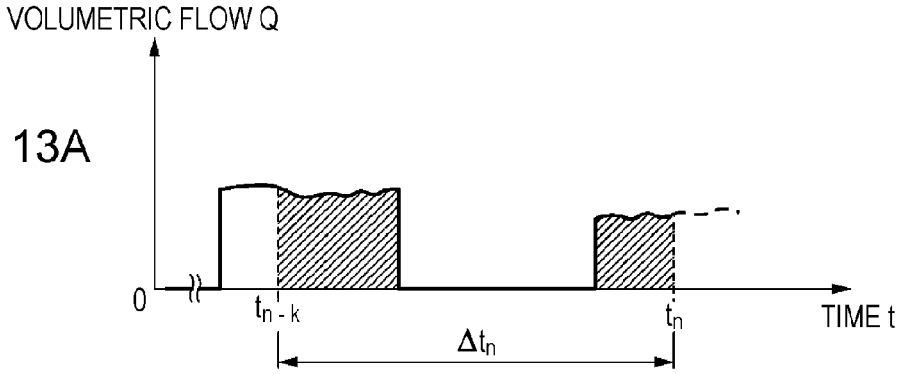
Figure 13B:
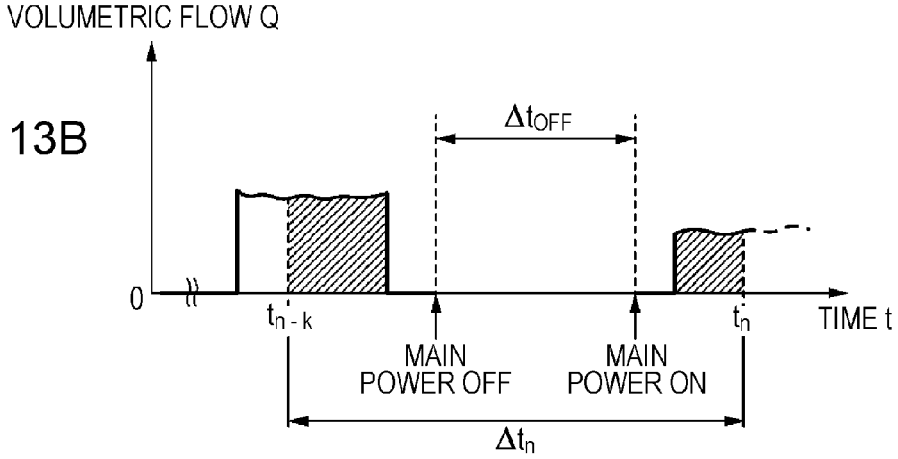

In the travel time calculation in step S102 in FIG. 10, in order to calculate the travel time $\Delta t_n$, implementation of the integration (accumulation) of the flow amount data has been described. When the integration is performed, going back the flow amount data in the past brings about a case where the flow amount is "0" and a case where there is no flow amount data. The ability to calculate the travel time $\Delta t_n$ even in such cases will be described below with reference to FIGS. 13A and 13B. In FIGS. 13A and 13B, each portion indicated by the thick lines in the graph is a portion in which the history of the volumetric flow Q is stored in the memory 122.

FIG. 13A illustrates a flow amount in a case where the history of the ink flow amount includes a period in which the flow amount is "0". In the example shown in FIG. 13A, in a period between two printing times, the flow amount is "0" since printing is not performed. In such a case, it is possible to go back the flow amount data in the past. Thus, by using integration similar to the above, the travel time $\Delta t_n$ can be calculated. In addition, in a case where a period in which the pixel gradation value is "0" continues, a period in which the flow amount is "0" appears as shown in FIG. 13A.

FIG. 13B illustrates a flow amount in a case where there is no history of the flow amount of ink. In the example shown in FIG. 13B, there is a period in which the main power supply is in the off-state. In a period after the main power supply is turned off until the main power supply is turned on, the history of the volumetric flow Q is not stored in the memory 122 (the main controller 120). It is noted that the flow amount is "0" since printing is not performed. FIG. 13B shows that the travel time $\Delta t_n$ is calculated by using the above fact. Specifically, when the main power supply is turned off, the main controller 120 stores, in the memory 122 (nonvolatile memory), a history of the volumetric flow Q obtained before the main power supply is turned off. The main controller 120 also writes, in the memory 122, the time the main power supply is turned off, and stops the entirety of the printer 100. In addition, after the main power supply is turned on again, in a case where, when integration for calculating the travel time $\Delta t_n$, the main controller 120 integrates flow amount data before the main power supply is turned on, by going back the flow amount data from the time the main power supply is turned off, as shown in FIG. 13B, the main controller 120 calculates the travel time $\Delta t_n$. The calculated travel time $\Delta t_n$ includes $\Delta t_{OFF}$ (period in which there is no history of the flow amount of ink) representing a time from the time the main power supply is turned off to the time the main power supply is turned on again. It is not necessary to write, in the memory 122, the time the main power supply is turned on again because the time can be specified by the time storing of the history of the flow amount data is restarted.

Case Where the Time the Main Power Supply is Turned Off Cannot be Written in Memory 122

In the description with reference to FIG. 13B, the time the main power supply is turned off can be written in the memory 122. However, there is one exception in which the time the main power supply is turned off cannot be written in the memory 122. This will be described with reference to FIG. 13C.

Figure 13C:
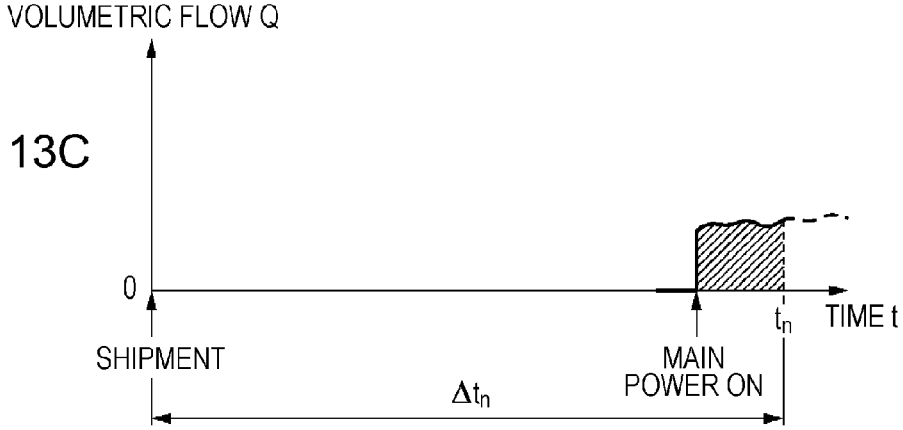
FIG. 13C shows an exception of the example shown in FIG. 13B.

FIG. 13C is a graph illustrating an exception of the example shown in FIG. 13B. In the example shown in FIG. 13C, when integration is performed, by going back the flow amount data in the past and the period in which there is no history of the flow amount of ink, a shipment time is determined. In other words, in a period after product shipment until the main power supply is turned on for the first time, the time the main power supply is turned off cannot be written in the memory 122. In this case, there is no data (such as the history of the volumetric flow Q stored in a nonvolatile memory) to be referred to. Accordingly, in the first embodiment, in the case of going back even the shipment time, a predetermined very larger value is set as the travel time $\Delta t_n$ without determining the end point $t_{n-k}$ (integration interval) of the integration. The shipment time is written in the memory 122 beforehand.

Second Embodiment

Next, a second embodiment of the invention will be described below with reference to FIGS. 14 to 15B. In the above-described first embodiment, the natural cooling after the ink arrives at the head case 140*a* is not considered. However, in the second embodiment, natural cooling of ink even in the head case 140*a* is considered. The configuration and components of a printing system according to the second embodiment are similar to those of the printing system 1 according to the first embodiment. Accordingly, by denoting them with identical reference numerals, their description is omitted.

Figure 14:
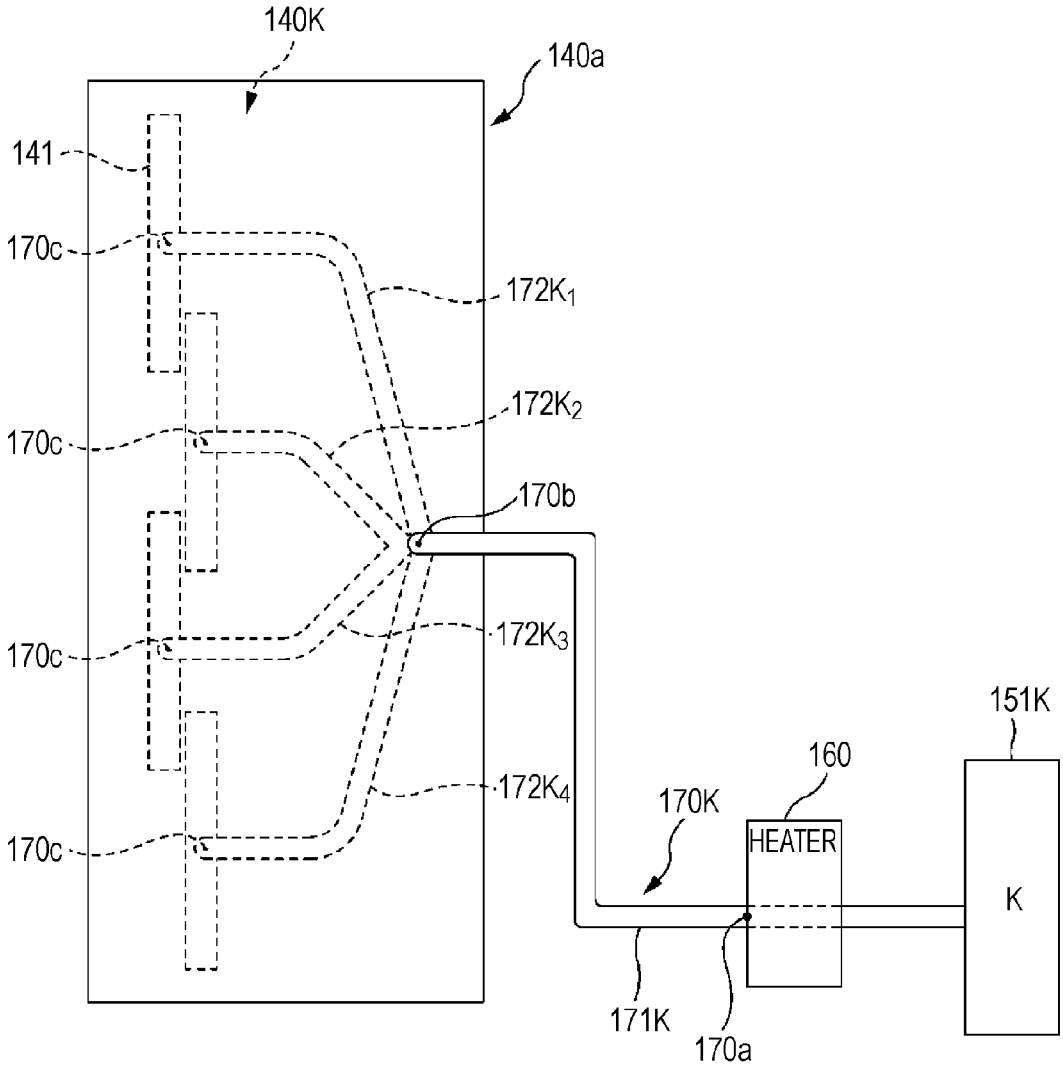
FIG. 14 is an illustration of a supply path for black ink in a second embodiment of the present invention.

FIG. 14 illustrates a supply path of the black ink. The ink supply path is identical to that in the first embodiment.

The tube 170K shown in FIG. 14 includes a main tube 171K and four subtubes 172$K_1$, 172$K_2$, 172$K_3$, and 172$K_4$ (hereinafter referred to also as "subtubes 172K"). As shown in FIG. 14, there is one main tube 171K and four subtubes 172K. The main tube 171K and the four subtubes 172$K_1$, 172$K_2$, 172$K_3$, and 172$K_4$ have contacts at the same position, that is, a head case contact 170*b*. At the head case contact 170*b*, one main tube 171K of the tube 170K branches off into the four subtubes 172K. Each subtube 172K connects to one head 141 at each head contact 170*c*. The black ink supplied to each subtube 171K is supplied to the head 141.

Next, how the black ink flows will be described with reference to FIG. 14. The black ink supplied from the ink pack 151K flows in the main tube 171K, and branches off at the head case contact 170*b*. The divided black ink is supplied to each head 141. Accordingly, the flow amount of the black ink flowing in the main tube 171K is equal to the discharge amount of black ink discharged by four heads 141 included in the head group 140K. In addition, the flow amount of the black ink flowing in one subtube 172K is equal to the discharge amount of black ink discharged by one head 141 to which the subtube 172K connects.

The length, cross section, and volume (path volume C') of each subtube 172K are identical to those of the other subtubes 172K. Data representing the path volume C' of each subtube 172K is written in the memory 122 beforehand. In addition, each subtube 172K differs from the main tube 171K in cross section, and the subtube 172K is thinner than the main tube 171K. A coefficient a' representing the degree of a heat release of each subtube 172K is also written in the memory 122 beforehand.

Also in the second embodiment, the driving waveform data is altered by performing a driving waveform data altering process similarly to that shown in FIG. 10. In other words, a travel time is calculated by using a flow amount, and, by using the travel time, an estimated ink temperature is calculated. When the estimated ink temperature is not within the viscosity-stability-temperature region, a potential difference $\Delta V$ corresponding to the estimated ink temperature is determined, and driving waveform data in which the determined potential difference $\Delta V$ is reflected is written in the memory 122.

In the first embodiment, the same driving signal is used to drive the four heads 141. In the second embodiment, driving signals for driving the heads 141 are respectively altered. To realize this, for each head 141, the driving signal generating circuit 124 is prepared (see FIG. 1). The number of driving signal generating circuits 124 is equal to the number of (16) heads 141 included in the line head 140. The flow amount of the black ink flowing in each subtube 172K differs for each head 141. Thus, for each head 141, a travel time is calculated, and, for each head 141, an ink temperature is calculated. For each head 141, driving waveform data is altered.

A method for calculating the ink temperature of black ink in one head 141 will be described below. Specifically, a method for calculating the ink temperature of black ink in the head 141 connecting to the subtube 172$K_1$.

Figure 15A:
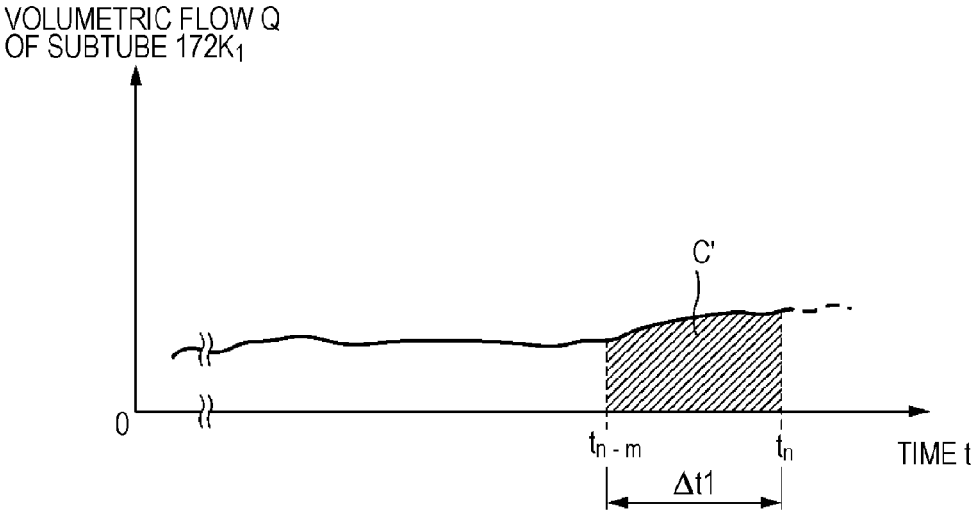

First, a travel time $\Delta t1$ in which the black ink arrives from the branch point (the head case contact 170*b*) at the head 141 (a head contact 170*c*) is calculated. By using a history (history of a discharge amount of one head 141) of the volumetric flow Q of the black ink flowing in the subtube 172$K_1$, integration is performed so as to be equal to (or slightly greater than) the path volume C'. From the integration interval, the time $t_{n-m}$ shown in FIG. 15A is determined, and a travel time $\Delta t1$ is calculated (see FIG. 15A). The integration is not described since it is almost similar to that in the above-described first embodiment. It is noted that, although the history of the volumetric flow Q for use in calculating the travel time in the first embodiment is a history of a total discharge amount of four heads 141, the history of the volumetric flow Q for use in calculating a travel time $\Delta t1$ in the second embodiment is a history of a discharge amount of one head 141. The calculated time $t_{n-m}$ represents the time the black ink in the head 141 was at the head case contact 170*b* (branch point).

Next, a travel time $\Delta t2$ in which the black ink arrives from the heater passage position 170*a* at the head case contact 170*b* (branch point) is calculated. In the second embodiment, the travel time $\Delta t2$, in which the black ink that was at the head case contact 170*b* (branch point) at time $t_{n-m}$ arrives from the heater passage position 170*a* at the head case contact 170*b* (branch point), is calculated. Accordingly, in the second embodiment, integration is performed (see FIG. 15B) going back from time $t_{n-m}$, with an integration start point as time $t_{n-m}$. Although the history of the volumetric flow Q for use in calculating travel time $\Delta t1$ is a history of a discharge amount of one head 141, the history of the volumetric flow Q for use in calculating the travel time $\Delta t2$ is a history of a total discharge amount of four heads 141. As shown in FIG. 15B, a travel time $\Delta t_n$ after the black ink starts at the heater passage position 170*a* and flows into the subtube 172$K_1$ until it arrives at the head contact 170*c* is represented by the sum of the travel time Δt1 and the travel time Δt2.

Subsequently, the ink temperature (estimated ink temperature $T_1$) of the black ink at the branch point is calculated by using expression (2). This calculation is not described since it is similar to that in the first embodiment. However, the time that is substituted for the time Δt in expression (2) is the travel time Δt2.

The ink temperature (estimated ink temperature $T_2$) of the black ink at the head contact 170*c* is calculated by using the following expression. However, the time that is substituted for the time Δt in the following expression is the travel time Δt1.

$$T_2=T(\Delta t)=T_1+(T_{air}-T_1)\times(1-e^{-\Delta t/a'}) \quad (3)$$

As described above, the estimated ink temperature $T_2$ of the black ink at the head contact 170*c* can be calculated. Thus, in the second embodiment, similarly to the process in FIG. 10, a driving waveform data altering process can be performed. Hence, also in the second embodiment, advantages similar to those in the first embodiment can be obtained.

Further, in the second embodiment, similar processing is performed also for the other heads 141 included in the head group 140K. This allows each head 141 to provide the advantages. Accordingly, each head 141 corresponds to a head that is driven in response to a driving signal to discharge ink.

For example, in a case where the flow amount of black ink discharged by one head 141 is large, and the flow amount of black ink discharged by another head 141 is small, ink temperatures in these heads 141 differ. Thus, according to the second embodiment, the waveforms of driving signals for driving the heads 141 are controlled to differ. Therefore, in the second embodiment, variations in ink droplet quantity are eliminated among the heads 141 having the same target quantity. Thus, deterioration in image quality can be further suppressed compared with the first embodiment.

Figure 15B:
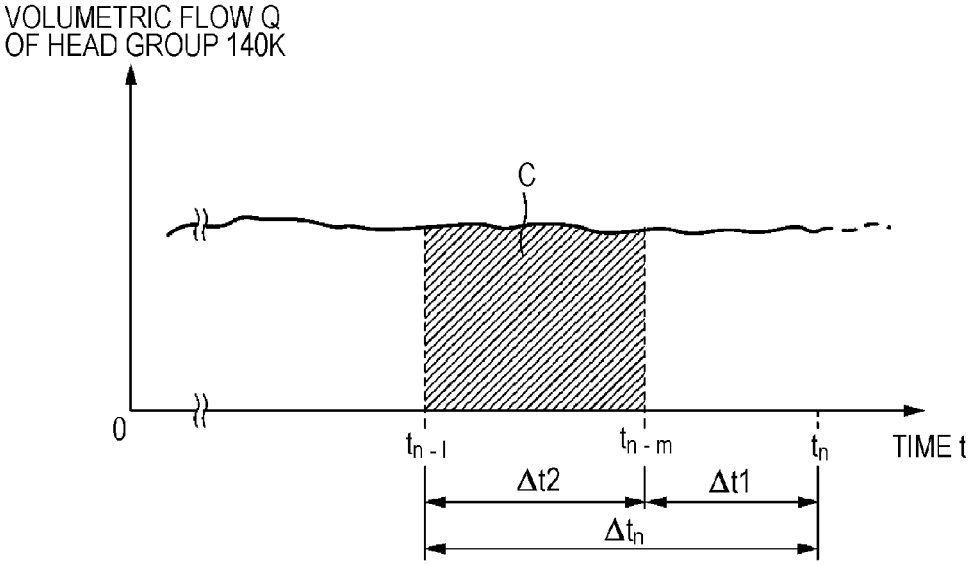

Although the description with reference to FIG. 14 to 15B mainly concerns the tube 170K, it can be similarly applied to the tubes 170C, 170M, and 170Y of the other colors. Accordingly, variations (color variations) in ink quantity among the heads 141 supplied with inks (of different colors) flowing in different tubes.

In the second embodiment, natural cooling after ink arrives at the head contact 170*c* is not considered. In other words, in the second embodiment, the ink temperature of ink at the head contact 170*c* is regarded as equal to the ink temperature of ink at the nozzle.

Here, the description of the second embodiment indicates that the ink temperature of ink at a downstream position (and at an upstream position than the next branch point) than the branch point can be calculated. In a case having a plurality of branch points, for each branch point, the ink temperature of ink at a downstream position than the branch point is calculated, whereby the ink temperature of ink at the nozzle can be finally calculated.

Third Embodiment

Next, a third embodiment of the invention will be described below. In the third embodiment, a flowmeter is used in order to create flow amount data. The configuration and components of a printing system according to the third embodiment are similar to those of the printing system 1 according to the first embodiment. Accordingly, by denoting them with identical reference numerals, their description is omitted.

Figure 16:
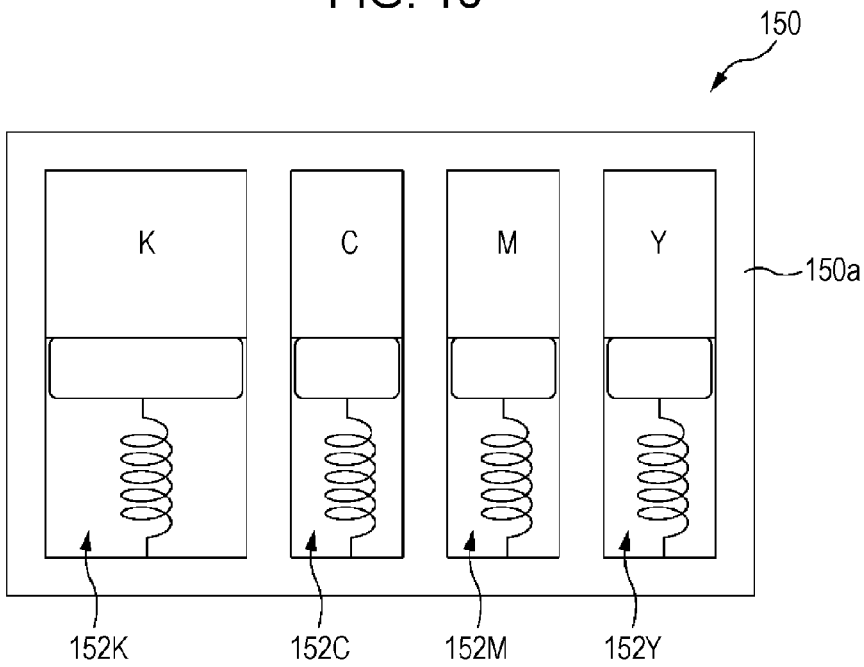
FIG. 16 is an illustration of flowmeters in an ink pack in a third embodiment of the invention.

The flowmeter 152K shown in FIG. 16 is formed of, for example, a contact sensor for detecting the volume of the ink pack 151K. As shown in FIG. 16, the flowmeter 152K includes a spring having one end fixed to one surface of internal walls 150*a* of the ink tank 150, and a plate member fixed to the other end of the spring. The flowmeter 152K is configured so that the plate member, which receives an extending force of the spring, presses ink, with the plate member touching the ink tank 150. The position of the plate member changes with the volume of the ink pack 151K.

The flowmeter 152K detects the volume of the ink pack 151K according to the position of the plate member every ten seconds, and transmits data of the detected volume to the main controller 120 via the internal interface 126. The CPU 121 stores the data of the volume from the flowmeter 152K in the memory 122, and also writes (the absolute value of) a volume change amount obtained every ten seconds as flow amount data in the memory 122. This data corresponds also to flow amount data of the black ink flowing in the tube 170K.

In other words, in the third embodiment, the main controller 120 uses the flowmeter 152K to create the flow amount data. After that, by performing processing similar to the driving waveform data altering process in FIG. 10, driving waveform data is altered.

According to the third embodiment, advantages identical to those obtained in the first embodiment can be obtained. In addition, according to the third embodiment, the flowmeter 152K is used to create flow amount data. Thus, it is not necessary to execute counting that counts items of dot gradation data for creating flow amount data. This makes it possible to reduce the processing load on the CPU 121 compared with the first embodiment.

Although the description with reference to FIG. 16 mainly concerns the flowmeter 152K, it can be applied to flowmeters 152C, 152M, and 152Y of the other colors.

Fourth Embodiment

Next, a fourth embodiment of the invention will be described below. In each of the above-described embodiments, the ink temperature in the head 141 is calculated. However, in the fourth embodiment, instead of calculating the travel time and the ink temperature, the flow amount Q of ink flowing in the tube is determined, and, from the flow amount Q, the potential difference ΔV of the driving signal COM is directly determined. In each of the above-described embodiments, the potential difference ΔV gradually changes. However, in the fourth embodiment, the potential difference ΔV changes in three stages.

The configuration and components of a printing system according to the fourth embodiment are similar to those of the printing system 1 according to the first embodiment. Accordingly, by denoting them with identical reference numerals, their description is omitted.

First, in the fourth embodiment, the main controller 120 calculates an ink discharge amount of ink discharged from the head group 140K in a unit time (e.g., 5 minutes), and determines the flow amount Q of ink flowing in the tube 170K. The discharge amount of the ink discharged from the head group 140K in the unit time is calculated on the basis of dot gradation data used in control of the head group 140K in the unit time. A method for calculating the discharge amount of ink is similar to that in the first embodiment. Accordingly, a description of the method is omitted.

Next, the main controller 120 determines the potential difference ΔV by referring to a table showing a relationship between the flow amount Q and the potential difference ΔV.

The table showing the relationship between the flow amount Q and the potential difference ΔV is stored in the memory 122 beforehand. The memory 122 stores plural types of tables. The main controller 120 refers to a table according to the outside air temperature $T_{air}$.

Figure 17:
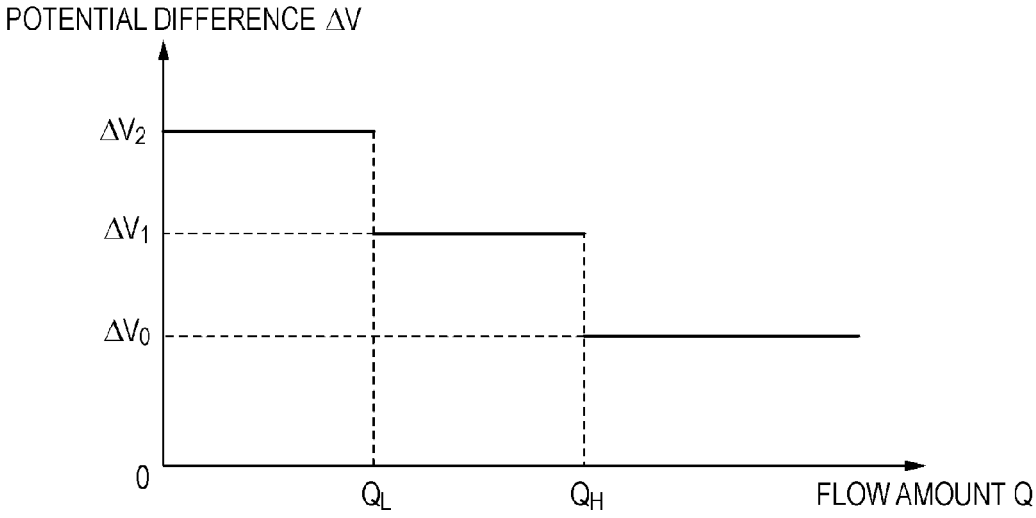
FIG. 17 is a graph illustrating a table between a flow amount Q and a potential difference ΔV in a fourth embodiment of the invention.

FIG. 17 is a graph illustrating the relationship between the flow amount Q and the potential difference ΔV. As shown in FIG. 17, when the flow amount is greater than a predetermined value $Q_H$, it is considered that the travel time is short, that is, it is considered that heat released from the tube 172K is less. Thus, the value of potential difference ΔV is determined to be potential difference $\Delta V_o$. However, when the flow amount Q is equal to or less than a predetermined value $Q_L$, it is considered that the travel time is long, that is, it is considered that heat released from the tube 172K is much. Thus, the value of the potential difference ΔV is determined to be potential difference $\Delta V_1$ that is greater than potential difference $\Delta V_0$. In addition, as the flow amount Q decreases, the value of the potential difference ΔV is determined to be a potential difference $\Delta V_2$ that is greater than potential difference $\Delta V_1$.

Although accuracy is less than that in the above-described first embodiment, also in the fourth embodiment, a change in quantity of ink droplets discharged from the head group 140K can be reduced. According to the fourth embodiment, the history of the flow amount Q does not need to be stored. Thus, the storage capacity of the memory 122 can be reduced. According to the fourth embodiment, the need to calculate the travel time and the ink temperature is eliminated. Thus, the calculating load can be reduced.

Similarly to the first embodiment, in the fourth embodiment, each of the head groups 140K, 140C, 140M, and 140Y is controlled so that a change in quantity of ink droplets is reduced. Instead, similarly to the second embodiment, each head 141 may be controlled so that a change in quantity of ink droplets is reduced.

Regarding Alteration of Driving Signal

In the above-described first to fourth embodiments, by altering the driving waveform data, the waveform of the driving signal COM is altered, and, as a result, a driving signal to be input to each piezoelectric element 142 is altered. A method for altering the driving signal to be input to the piezoelectric element 142 is not limited thereto. For example, the switch operation signal may be altered without altering the driving waveform data and the waveform of the driving signal COM. In the case of forming a large dot (see FIG. 5D), by using the switch operation signal to (also select the pulse SS4) add a small dot, the driving signal to be input to the piezoelectric element 142 is altered. Thereby, the quantity of ink droplets that is decreased from a target quantity of 21.0 pL is increased by 2 pL, thus enabling maintenance of the quantity of ink droplets.

Other Embodiments

Printers, etc., have been described as the individual embodiments. However, the foregoing embodiments are intended to facilitate understanding of the invention, and are not used to interpret the invention in limited sense. The invention can be altered and improved without departing the gist thereof, and it is needless to say that the invention includes equivalents thereof. In particular, even the following embodiments are included in the invention.

Regarding Heaters 160

In each of the first to fourth embodiments, the heater 160 is disposed so as to surround a part of regions for four tubes 170K, 170C, 170M, and 170Y. However, for each of the tubes 170K, 170C, 170M, and 170Y, one heater may be installed.

In addition, each of the first to fourth embodiments describes a case where ink flowing in each tube releases heat. However, such a case may include a state in which ink flowing in the tube is heated by an outside air temperature $T_{air}$. In addition, a cooler may be provided as an adjustment unit for adjusting a temperature instead of the heater 160.

Regarding Head 141

In each of the foregoing embodiments, the piezoelectric elements 142 are used to discharge ink.

However, instead of the piezoelectric elements 142, other types of piezoelectric elements and heat generators may be used. In the case of using heat generators, a head discharges ink by using a bubble generated in a nozzle.

Regarding Ink Discharging Apparatus

In each of the first to fourth embodiments, a printer is exemplified as an ink discharging apparatus in which each head driven in response to a driving signal discharges ink. However, what is discharged by the head is not limited to ink, but may be any type of liquid. The liquid may be one in which dispersed material (for example, a colorant in the case of ink) is dispersed (dissolved) in a dispersion medium (for example, water in the case of ink) and may be a type of liquid (for example, water or oil). Liquid discharging apparatuses provided with heads for discharging the above liquid include printing apparatuses that perform printing cloth, semiconductor manufacturing apparatuses that manufacture semiconductor chips, display manufacturing apparatuses that manufactures displays, and microarray manufacturing apparatuses that manufacture microarrays (deoxyribonucleic acid (DNA) chips).

The entire disclosure of Japanese Patent application No. 2007-169659, filed Jun. 27, 2007 is expressly incorporated by reference herein.

What is claimed is:

1. A liquid discharging apparatus comprising:

a head that is driven in response to a driving signal to discharge liquid;

a controller that drives the head by generating the driving signal;

an adjustment unit that adjusts the temperature of the liquid, the adjustment unit being disposed separate from the head; and a supply path that supplies the head with the liquid having the temperature adjusted by the adjustment unit, wherein the controller alters the driving signal in accordance with a flow amount of the liquid, which flows in the supply path, wherein the flow amount is calculated on the basis of discharge data for causing the head to discharge the liquid, and the controller alters the driving signal in accordance with the calculated flow amount, and wherein, on the basis of the flow amount calculated on the basis of the discharge data, the controller calculates a travel time representing a time taken until the liquid having the temperature adjusted by the adjustment unit arrives from the position of the adjustment unit at the head, and alters the driving signal in accordance with the calculated travel time.

2. The liquid discharging apparatus according to claim 1, wherein the controller estimates the temperature of the liquid in the head on the basis of the calculated travel time, and alters the driving signal in accordance with the estimated temperature.

3. The liquid discharging apparatus according to claim 1, wherein the controller alters the waveform of the driving signal on the basis of the discharge data.

4. The liquid discharging apparatus according to claim 1, further comprising a flowmeter that measures the flow amount of the liquid, which flows in the supply path, wherein the controller alters the driving signal in accordance with the measured flow amount.

5. The liquid discharging apparatus according to claim 1, further comprising a head that is different from the head and that discharges the liquid supplied through the supply path.

6. The liquid discharging apparatus according to claim 1, further comprising a head that is different from the head and that discharges liquid supplied through a supply path different from the supply path.

7. A liquid discharging method comprising:

adjusting the temperature of a liquid using an adjustment unit which is disposed away from a liquid discharging head;

supplying the head with the liquid having the adjusted temperature;

generating a driving signal using a controller; and driving the head in response to the driving signal and discharging the liquid from the head, wherein the driving signal is altered in accordance with a flow amount of the liquid supplied to the head, wherein the flow amount is calculated on the basis of discharge data for causing the head to discharge the liquid, and the controller alters the driving signal in accordance with the calculated flow amount, and wherein, on the basis of the flow amount calculated on the basis of the discharge data, the controller calculates a travel time representing a time taken until the liquid having the temperature adjusted by the adjustment unit arrives from the position of the adjustment unit at the head, and alters the driving signal in accordance with the calculated travel time.

8. A computer-readable storage medium for recording computer program for a liquid discharging apparatus including:

a head that is driven in response to a driving signal to discharge liquid;

a controller that drives the head by generating the driving signal;

an adjustment unit that adjusts the temperature of the liquid, the adjustment unit being disposed separate from the head; and a supply path that supplies the head with the liquid having the temperature adjusted by the adjustment unit, the program causing the liquid discharging apparatus to alter the driving signal in accordance with a flow amount of the liquid, which flows in the supply path, wherein the flow amount is calculated on the basis of discharge data for causing the head to discharge the liquid, and the controller alters the driving signal in accordance with the calculated flow amount, and wherein, on the basis of the flow amount calculated on the basis of the discharge data, the controller calculates a travel time representing a time taken until the liquid having the temperature adjusted by the adjustment unit arrives from the position of the adjustment unit at the head, and alters the driving signal in accordance with the calculated travel time.

* * * * *